US009694936B2

(12) United States Patent
DeBattiste

(10) Patent No.: US 9,694,936 B2
(45) Date of Patent: Jul. 4, 2017

(54) LIFTING AND TRANSPORTING SYSTEM

(71) Applicant: Larry R. DeBattiste, Enfield, NH (US)

(72) Inventor: Larry R. DeBattiste, Enfield, NH (US)

( * ) Notice: Subject to any disclaimer, the term of this patent is extended or adjusted under 35 U.S.C. 154(b) by 323 days.

(21) Appl. No.: 14/629,927

(22) Filed: Feb. 24, 2015

(65) Prior Publication Data

US 2016/0244204 A1 Aug. 25, 2016

(51) Int. Cl.

| | |
|---|---|
| ***B65D 19/42*** | (2006.01) |
| ***B66C 1/12*** | (2006.01) |
| ***B66F 3/24*** | (2006.01) |

(52) U.S. Cl.

CPC ..... *B65D 19/42* (2013.01); *B66C 1/12* (2013.01); *B66F 3/24* (2013.01); *B65D 2519/00781* (2013.01); *B65D 2519/00786* (2013.01)

(58) Field of Classification Search

CPC ..... B65D 19/40; B65D 19/42; B66F 3/36
USPC ..... 414/458
See application file for complete search history.

(56) References Cited

U.S. PATENT DOCUMENTS

| | | | | |
|---|---|---|---|---|
| 3,570,694 | A | | 3/1971 | Tantlinger |
| 3,749,363 | A | | 7/1973 | Hauser |
| 4,333,617 | A | | 6/1982 | Hamilton |
| 4,516,901 | A | | 5/1985 | Riedl |
| 4,765,594 | A | | 8/1988 | Riedl et al. |
| 5,044,864 | A | | 9/1991 | Stefan |
| 6,062,545 | A | * | 5/2000 | Peavler ..... B60D 1/66 254/418 |
| 6,095,533 | A | | 8/2000 | Balolia |
| 6,371,496 | B1 | | 4/2002 | Balolia |
| 6,431,805 | B2 | | 8/2002 | Lanciaux, Jr. |
| 6,756,547 | B2 | | 6/2004 | Lefler |
| 6,939,098 | B2 | | 9/2005 | Schults |
| 8,672,296 | B2 | | 3/2014 | Cozza et al. |
| 2011/0068548 | A1 | | 3/2011 | Houggard et al. |

* cited by examiner

*Primary Examiner* — Jonathan Snelting
(74) *Attorney, Agent, or Firm* — Jeffrey E. Semprebon

(57) ABSTRACT

Jack units are employed to attach skates to an object to be moved. Each jack unit has a tongue that slidably engages a coupling slot affixed to the object, and can be operated to raise or lower the tongue; when raised, the object is supported on the skates and can be rolled to a new location. A crane can attach to lift eyes on the jack units to allow the system to be lifted with the skates attached to the object, avoiding the risk of positioning the skates while the object is suspended. Rotation-limiting structures can be employed to block rotation of the trailing skates to facilitate steering when rolling the object supported by the system. The coupling slots can be provided in coupling elements which can attach directly to the object or which can be employed to form a freestanding frame to which the object is secured.

18 Claims, 19 Drawing Sheets

Figure 28
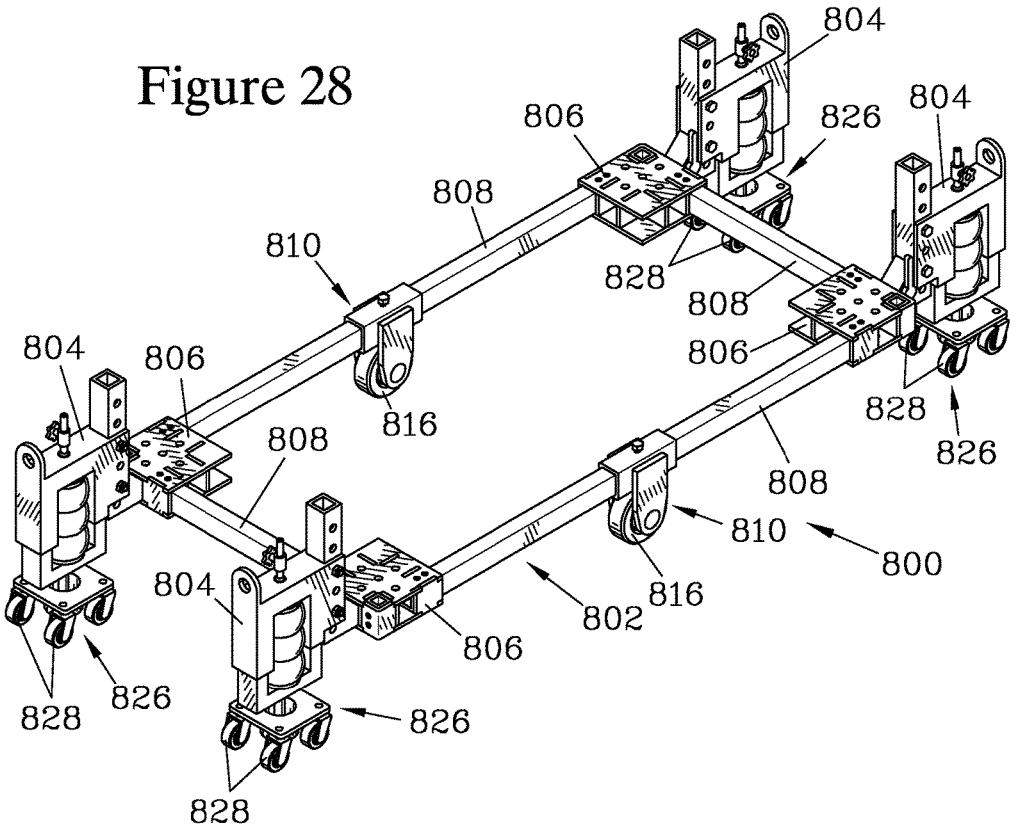
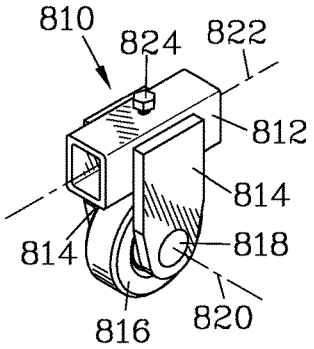
Figure 29
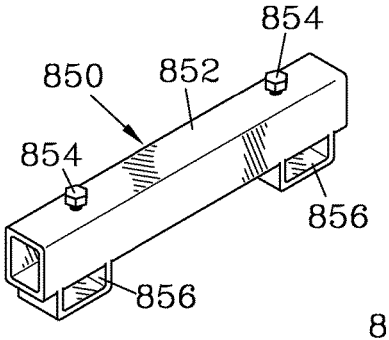
Figure 30
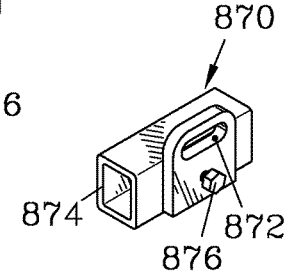
Figure 31

LIFTING AND TRANSPORTING SYSTEM

BACKGROUND OF THE INVENTION

To move objects that are too large and/or heavy to be placed onto a cart, skid, or similar device, it is frequently necessary to lift the object and place skates or rollers (hereinafter simply referred to as "skates") under the object to support its weight and to allow it to be rolled across a surface to a new location. Such movement causes risks of injury to the movers and damage to the object if the object slips and becomes disengaged from one or more of the skates as it is transported. An additional risk of injury occurs when an object is lowered from a crane onto skates, as moving personnel must work in close proximity to the suspended object in order to position the skates under the object. There is a need to reduce such injury risks to provide greater safety for persons moving large and heavy objects, as well as to reduce the risk of damage due to accidents while such objects are being moved.

SUMMARY OF THE INVENTION

The present invention provides a lifting and transporting system for safely moving large and/or heavy objects. The system employs a number of jack units, each of which serves to releasably but securely attach a skate, roller, or similar device (hereinafter simply referred to as a "skate") to the object and to retain the skate connected to the object throughout the moving procedure. The jack unit allows the object to be lifted off of the underlying surface so as to be supported on the skate and thereafter moved to a new location. Once positioned, the object can be lowered so that the skate may be removed. The system can be designed such that the jack units are compact and lightweight enough to be readily positionable by an individual operator. Calculations indicate that a system of the present invention could be built with jack units weighing in the range of 50 lbs., including the attached skates, and would have the ability to lift and transport a 10-ton object.

The jack units each have a jack housing and an extendable element that can be forcibly extended from the jack housing, and which can retract into the jack housing; in use, the extendable element extends and retracts along a vertical lift axis. The extension and retraction can be provided by hydraulic, pneumatic, or mechanical means, depending on the particular applications for which the jack unit is intended. A tongue is affixed with respect to the jack housing so as to extend along a horizontal tongue axis, and in many embodiments is provided on a jack extension that can be affixed to the jack housing at one of multiple vertical positions. The tongue is provided with tongue bearing surfaces that are parallel to the tongue axis, and has a tongue latching structure. The tongue bearing surfaces are configured to slidably engage a coupling slot that is affixed with respect to the object to be moved; the coupling slot can be formed integrally with the object or can be provided on a coupling element or frame to which the object is secured. The coupling slot has coupling slot bearing surfaces that slidably engage the tongue bearing surfaces in such a manner as to limit motion between the tongue and the coupling slot to translational motion along the tongue axis. The coupling slot also has a coupling slot latching structure configured to be lockably engaged by the tongue latching structure; when the latching structures are engaged, their engagement acts to block translation between the tongue and the coupling slot.

The extendable element is coupled to one of the skates such that extension and retraction of the extendable element serves to raise and lower the tongue (which is affixed to the jack housing) relative to the skate when the skate rests on an underlying surface. Thus, when the tongue is engaged in the coupling slot, extension of the extendable element acts to raise the object off the underlying surface via the engagement of the tongue with the coupling slot which is secured to the object. When all the jack units of the system have been so extended, the object is lifted off the surface and is supported on the skates, and may then be rolled to a new location. During such rolling operation, the engagement of the tongue with the coupling slot maintains the skate in position relative to the object being moved. Once it has reached the desired location, each of the jack units is operated to retract the extendable element into the jack housing, which acts to lower the tongues relative to the skates, thereby lowering the coupling slots until the object secured thereto rests on the underlying surface in the new location.

When the skates employed do not have caster wheels, the attachment of the skate to the extendable element is such as to allow the skate to rotate about the vertical lift axis to allow the system to be steered when moved. Such rotation could be provided by allowing the extendable element to rotate with respect to the jack housing, or by rotatably mounting the skate to the extendable element. In many situations, it is preferable for the skate to not only be rotatably attached to the extendable element so as to rotate about the vertical lift axis, but to be pivotably mounted so as to also provide limited motion about horizontal axes, to accommodate travel over uneven surfaces and to allow the skate to travel over small obstructions. Connecting the skate to the extendable element via a ball joint or similar flexible joint is one way to allow such pivoting motion. Such flexible movement of the skates helps to balance the load on the jack units to preserve the load capacity of the system by avoiding overloading due to travel over uneven surfaces.

While the skates that are leading in the direction of travel of the object need to be steered, it is typically easier to maneuver the object if the trailing skates are prevented from rotating about the lift axes of the jack units to which they are attached. This could be accomplished by employing dedicated leading and trailing jack units; however, to simplify the system and better accommodate for changes in direction, it is preferred for each of the jack units to have a selectively engagable motion-limiting structure that provides the operator with the option to allow or to block rotation of the skate attached to that particular jack unit. When such a motion limiting structure allows blocking the rotation of the skate in at least two positions, it facilitates changes in the direction of movement of the object. Additionally, the structure can be provided with means for adjusting the alignment of the skate to correct misalignment of the skate and/or structure to which the jack units are attached, eliminating toe-in/out and enhancing tracking of the wheeled load.

To allow the object to be lifted by a crane or similar hoisting device, the jack units can each be provided with a lift eye configured to allow connecting a strap or chain to the jack unit by a shackle or similar device known in the art. When the tongues of the jacks are latched into the coupling slots secured to the object to be moved, connecting the lift eyes to a crane allows the crane to raise the object from the underlying surface and lower it to a new surface, while the skates remain attached to the object. This avoids any need for personnel to work in close proximity to the object while it is suspended, since the skates are maintained in position and thus need not be manually placed under the object as it is lowered. Additionally, since the jack units only need access to the coupling slots, the remainder of the object to be moved can remain enclosed in a crate or similar protective covering during the moving procedure. Furthermore, when the object to be moved is enclosed in a crate, the system of the present invention does not engage the crate, and thus avoids damage to the crate from stresses caused during transport.

While the coupling slots could be formed as a part of the object to be moved, the system of the present invention can include coupling elements that can be attached directly to an object to be moved or can be employed to form a frame to which an object is secured. Each coupling element is preferably provided with two coupling slots that extend orthogonally, allowing the tongue of the jack unit to be mounted in either of two positions. This allows the jack unit and attached skate to be mounted to the front and back of the object, thereby reducing the overall width of the system to facilitate passage through narrow spaces, or to be mounted alongside the object, thereby providing greater stability. In some situations, an obstruction can be bypassed by lowering the object to rest on the underlying surface and repositioning one or more of the jacks from a position on one side of the obstacle to position on the other side.

When a free-standing frame is desired, the coupling elements should be formed with frame member receptors for accepting elongated frame members, which can be cut to length from tube stock. The coupling elements can form the corners of a frame, and frequently allow the frame to be formed in place around an object to be moved.

BRIEF DESCRIPTION OF THE FIGURES

FIG. 2 shows one of the jack units positioned to be moved into engagement with one of the coupling elements. The height of the tongue is positioned to match the height of the slots on the coupling element, which is supported above the underlying surface by one of the leveling feet.

FIG. 3 illustrates the system shown in FIGS. 1 and 2 when the jack unit has been advanced to insert the tongue into the coupling slot to lockably engage the jack unit with the coupling element, and thus to the object to be moved, which is secured to the coupling element.

FIG. 4 illustrates the system shown in FIGS. 1-3 when the jack unit has been activated to forcibly extend the extendable element from the jack housing. This extension acts to raise the tongue relative to the skate attached to the extendable element, which lifts the leveling foot off the underlying surface so that the weight of the object is supported on the skate. Once the object is supported on the skates, it can be rolled to a desired location.

FIG. 9 also illustrates how the system and the object to which it is attached can be lifted by a crane through the use of cables or straps attached to lift eyes that are formed as integral parts of the jack housings. Since the jack units remain attached to the object when lifted, there is no requirement to position skates under the load when it is to be set down in a new location, thus avoiding the risk inherent in working in close proximity to the load while it is suspended.

FIG. 10 shows the elements exploded, while FIG. 11 shows them when assembled. In this embodiment, an upper knee member can be pivotably attached to a knee indexing lug that is affixed to the jack housing, while a lower knee member is pivotably attached to a skate lug provided on the skate and to the other end of the upper knee member. The lower knee member in this embodiment is extended so as to also serve as a T-handle for allowing an operator to push the skate to which it is mounted. When the upper knee member is disengaged, allowing the skate to be steered, the T-handle can be pulled by the operator to guide movement of the system.

FIG. 11 illustrates the knee elements shown in FIG. 10 when assembled and pivotably engaged with the jack housing and with the skate. The knee indexing lug to which the upper knee member is attached is provided on a lug plate that can be positioned on the jack housing so as to maintain the skate in one of three orthogonal directions. The lug plate is designed to position the knee indexing lug slightly spaced from the jack housing, and the exact orientation of the lug can be adjusted by set screws threadably mounted in the lug plate to allow adjusting for toe-in or toe-out of the skate. When the elements of the knee are connected as shown in FIG. 11, the connection limits the pivotal action of the skate about the lift axis, while allowing the piston to freely extend and retract. The limited motion of the skate helps to assure that all wheels on a skate traverse a path that is parallel to the axis of travel to prevent crabwise movement of the object. When connected, the knee structure also serves to maintain the T-handle in a raised position to ease pushing or pulling the jack unit, as well as forming a relatively rigid structure that simplifies handling the jack unit when detached from the coupling element.

FIG. 28 illustrates a lifting and transporting system that forms another embodiment of the present invention, which is designed to move relatively small objects within confined spaces. The system has four pneumatic jack units attached to ends of a frame, as well as a pair of supplementary wheel attachments that are centrally-mounted to the frame. The jacks can be lowered, such that the system rests on supplementary wheels of the attachments and caster wheel skates attached to the jack units at one end of the frame, when it is desired to steer the system using the supplementary wheels. The jack units can be raised to raise the frame to a height where the supplementary wheels are lifted above the underlying surface, so that the system is supported only on the caster wheel skates attached to the four jack units.

FIG. 29 illustrates one of the supplementary wheel attachments employed in the system shown in FIG. 28 when the attachment is removed from the frame. The attachment has a sleeve sized to slide over a frame member prior to assembly of the frame, and a set bolt that secures the attachment in place. A wheel is mounted under the sleeve so as to rotate about an axis perpendicular to a frame member on which the attachment is mounted.

FIG. 30 illustrates another attachment that can be mounted onto a frame to increase the functionality of the frame of the present invention. This attachment is a forklift pocket attachment that again mounts to a frame member via a sleeve and is secured in position by set bolts. Two tine pockets are affixed below the sleeve, and are configured to be engaged by the tines of a forklift to allow the frame to be safely lifted and transported.

FIG. 31 illustrates an anchor point attachment that is another example of an attachment that can be employed with the frame of the present invention. The attachment has an anchor slot affixed to the sleeve; when secured in position on a frame member, the attachment provides a location to which a strap can be attached to facilitate securing an object to be moved onto the frame.

DETAILED DESCRIPTION

Figure 1:
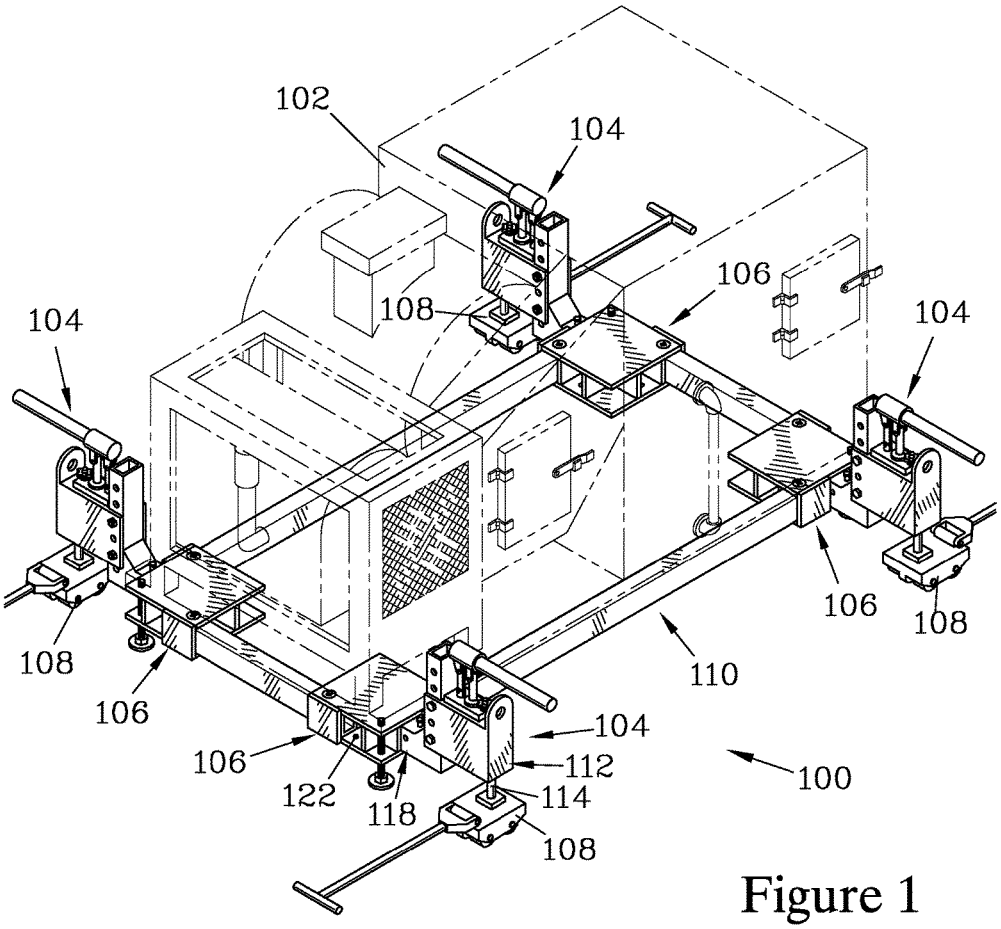
FIG. 1 is an isometric view of one embodiment of the lifting and transporting system of the present invention, shown engaged with an object to be transported (shown in phantom and not part of the invention). The system in this embodiment includes four jack units, each of which is positioned near one corner of the object. Each jack unit is engaged with a coupling element which forms one corner of a frame on which the object is supported and to which the object can be secured by straps, fasteners, or welding. Each jack has a jack housing and a vertically positionable jack extension having a tongue that is configured to slidably and latchably engage a matching slot in the coupling element. Each jack has an extendable element that attaches to a skate that supports the jack and allows rolling the object across a surface; in this embodiment, the extendable element is a cylindrical piston and rotation of the piston in the jack housing allows the skate to steer. The coupling elements shown each have an adjustable-height leveling foot, and are configured to allow the tongue to be inserted from either of two adjacent sides, allowing the jack to be inserted on either the side or the end of the object to be transported. As illustrated, the jacks attach to the sides of the frame so as to extend beyond the side of the load carried by the frame.

FIG. 1 is an isometric view of one embodiment of a lifting and transporting system 100 of the present invention, which is shown engaged with a load 102 (shown in phantom in FIG. 1). The system 100 includes a set of jack units 104 that lockably engage coupling elements 106 that, in turn, are secured to the load 102. Each of the jack units 104 has a skate 108 attached thereto, providing a load-bearing support for the jack unit 104 which can be rolled over an underlying surface. In the system 100, four jack units 104 are employed, and the coupling elements 106 form the corners of a frame 110 to which the load 102 is secured by attachment means (not shown), which could include straps, fasteners, welding, or other attachment means known in the art.

Figure 2:
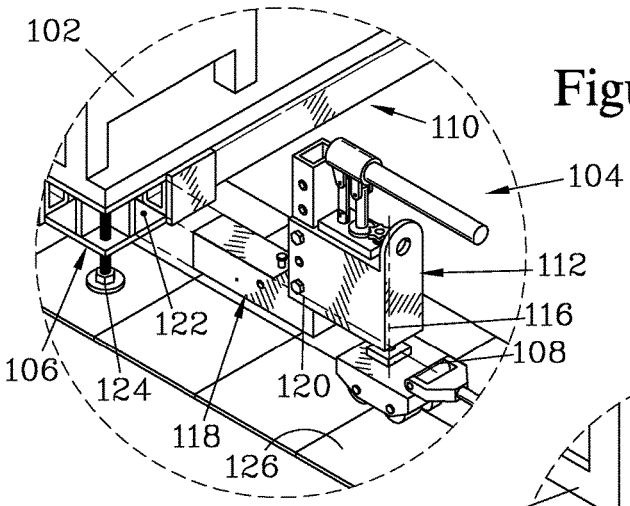
FIGS. 2-4 are detail views showing one corner of the system shown in FIG. 1, illustrating the operation of the system.
Figure 3:
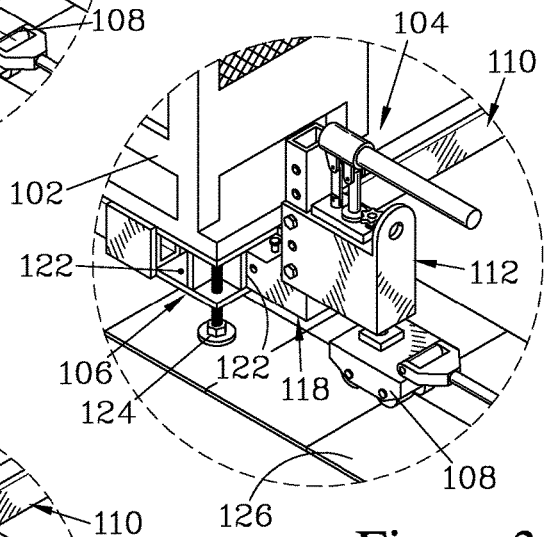
Figure 4:
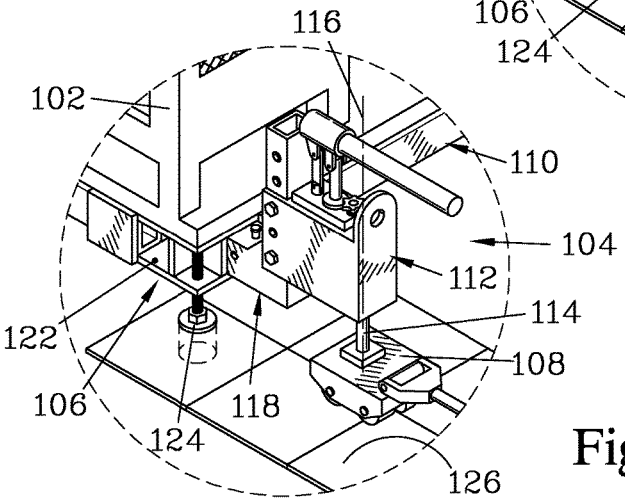

FIGS. 2-4 illustrate the interaction of one of the jack units 104 with one of the coupling elements 106. The jack unit 104 has a jack housing 112 and an extendable element 114 (shown in FIG. 4) that can be forcibly extended from the jack housing 112 along a vertical lift axis 116. The skate 108 is attached to the extendable element 114, and thus extension and retraction of the extendable element 114 acts to change the separation distance between the jack housing 112 and the skate 108.

The jack unit 104 has a tongue 118 that is affixed to the jack housing 112 so as to extend along a horizontal tongue axis 120, and which is designed to slidably and lockably engage a coupling slot 122 provided in the coupling element 106. This engagement is discussed below with regard to FIG. 6. While the system 100 employs the frame 110, the jack units 104 could also be employed to lift and transport a load that has coupling slots provided as an integral part of the load. Each coupling element 106 of the system 100 has a threadably-adjustable leveling foot 124 that engages an underlying surface 126 to locate the coupling slot 122 at a set height thereabove.

As shown in FIG. 2, to engage the jack unit 104 with the coupling element 106, the jack unit 104 is configured with the tongue 118 at a height where it can be slidably inserted into the coupling slot 122. Once inserted, as shown in FIG. 3, the coupling element 106 can be supported on the tongue 118. When the jack unit 104 is activated to forcibly extend the extendable element 114, as shown in FIG. 4, the jack housing 112 and the tongue 118 affixed thereto are raised relative to the skate 108, and the supportable engagement of the tongue 118 with the coupling slot 122 lifts the coupling element 106 off the surface 126. Once raised, the coupling element 106 is supported relative to the skate 108, as are as the frame 110 (of which the coupling element 106 is a part) and the load 102 secured thereto, allowing the load 102 to be rolled over the surface 126 to a new location.

Figure 5:
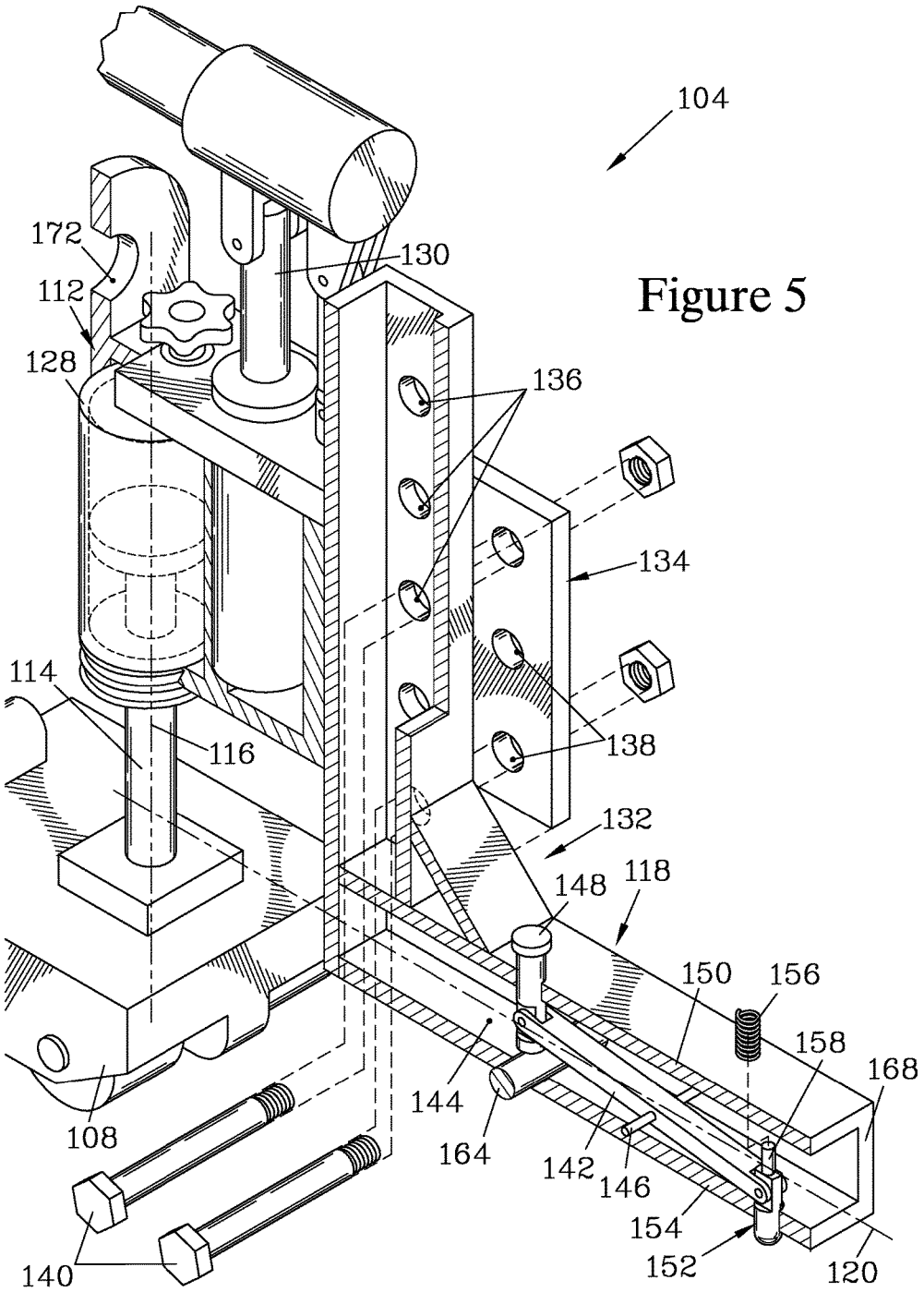
FIG. 5 is a view illustrating one of the jack units of the system shown in FIGS. 1-4, which is shown partially sectioned to better show some of the elements of the jack unit. The jack housing has a lift axis, along which the extendable element can be extended or retracted, while the jack extension has a tongue axis along which the tongue extends. The jack housing in this embodiment has a channel configured to accept a column that forms part of the jack extension. A series of equally-spaced holes are provided through the housing and the column so that they can be selectively aligned and secured together by bolts, thereby allowing the vertical position of the extension to be adjusted to position the tongue at an elevation to match its height to the height at which the coupling elements are mounted on the object to be moved. To latch the tongue to the coupling element, the tongue has a spring-loaded pin that engages a matching socket in the coupling element when the tongue is fully inserted into the slot. The pin can be retracted by a release button, and a cross-pin can be inserted through the tongue to block the release button to prevent inadvertent retraction of the pin.

FIG. 5 is a sectioned view of one of the jack units 104. The jack unit 104 shown employs a hydraulic piston as the extendable element 114. Contained in the jack housing 112 is a hydraulic cylinder 128 driven by a manually-operated pump 130. The pump 130 can be operated to increase the pressure in the cylinder 128, and this increased pressure drives the extendable element 114 downward. If the pressure in the cylinder 128 is released, the extendable element can retract into the jack housing 112.

The tongue 118 could be affixed directly to the jack housing 112, but greater flexibility in adjusting the height of the tongue 118 is provided by forming the tongue 118 as part of a jack extension 132 that can be affixed to the jack housing 112 at varying heights. In the jack unit 104, such vertical adjustment is provided by a channel 134 on the jack housing 112 that slidably engages the jack extension 132, in combination with a series of spaced extension passages 136 and matching channel passages 138 that can be aligned to set the desired height before being secured together by bolts 140 passing through the aligned passages (136, 138). The adjustment to the height of the tongue 118 allows the tongue 118 to be positioned to engage the coupling slot 122 (shown in FIGS. 1-4) when positioned at various heights while requiring little, if any, extension of the extendable element 114 to vary the height. The jack units 104 could be employed to move a load that is provided with integral coupling slots, in which case variation in the height of the tongue 118 allows greater freedom in locating such coupling slots on the load. Preliminary analysis indicates that the jack extension 132 is a critical component when determining load capacity, and for typical loading applications it is felt that the jack extension 132 can be fabricated from high grade steel square tube stock, either 2-inch or 2½-inch square, with a ¼-inch wall thickness.

Figure 6:
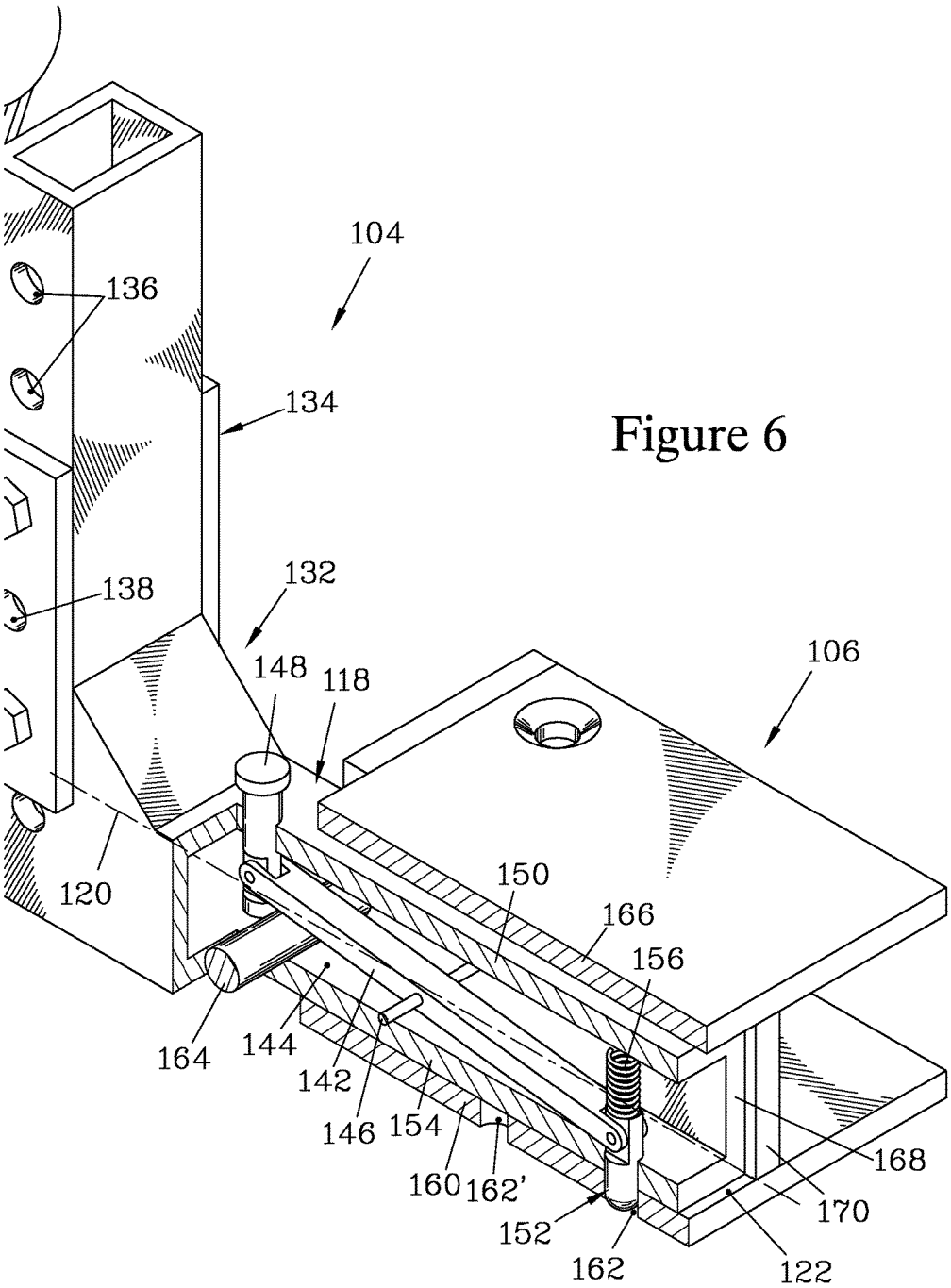
FIG. 6 is a sectioned view illustrating the latching of the tongue with the coupling element, as well as the linkage for allowing the latching pin to be retracted and a blocking pin to prevent accidental release.

FIG. 6 illustrates the engagement of the tongue 118 with the coupling element 106, showing one scheme for lockably engaging the tongue 118 in the coupling slot 122. In this embodiment, the tongue 118 has a beam 142 which is pivotably mounted in a cavity 144 in the tongue 118 by a pivot pin 146. Attached to the beam 142 in the region closest to the jack housing 112 is a release pin 148 which is pivotably attached to the beam 142 and passes through a tongue top wall 150 of the tongue 118. At the other end region of the beam 142, a latch pin 152 is pivotably attached to the beam 142, the latch pin 152 passing through a tongue bottom wall 154 of the tongue 118. A compression spring 156 is mounted on an latch pin extension 158 so as to bias the latch pin 152 to protrude beyond the tongue bottom wall 154.

The coupling element 106 has two coupling slots 122 (only one of which is visible in FIG. 6) that extend orthogonally to each other, each being configured to slidably engage the tongue 118; in combination, the coupling slots 122 allow the tongue 118 to be inserted in either of two orientations, so as to reside either to the side of the load 102 (as shown in FIG. 1) or in front or behind the load 102. Referring again to FIG. 6, each coupling slot 122 has a slot bottom wall 160 that is provided with a latch hole 162 positioned to be engaged by the latch pin 152 to lock the tongue 118 in the coupling slot 122. To release the tongue 118, the operator pushes the release pin 148, which pivots the beam 142 so as to retract the latch pin 152 (against the bias of compression spring 156) from the latch hole 162, after which the tongue 118 can be slid along the tongue axis 120 out of the coupling slot 122. To prevent accidental release, a cross-pin 164 can be provided through the tongue 118, positioned to block pivoting of the beam 142. In some situations, it is desirable to attach the jack unit 104 to the coupling element 106 with the tongue 118 only partly inserted; for such situations, one or more additional latch holes 162' can be provided. However, the load rating of the system 100 is reduced when the tongue 118 is lockably engaged with the coupling slot 122 at such an intermediate position. Markings could be provided on the tongue 118 to indicate the load rating at each position of insertion. The latch hole 162' illustrated is centrally positioned (as better shown in FIG. 8) so as to accept the latch pin 152 when the tongue 118 is inserted into either of the orthogonal coupling slots 122. Additional flexibility of the system 100 could be provided by including one or more latch holes in a slot top wall 166 of the coupling slot 122, allowing the tongue 118 to be latchably engaged with the coupling slot in an inverted position, such as the position illustrated in FIG. 8 and discussed below.

In the system 100, the tongue 118 is formed as a rectangular tube with its top and bottom walls (150, 154) extending parallel to the tongue axis 120, as well as having tongue sidewalls 168 (only one of which is shown in the sectioned view of FIGS. 5 and 6) that also extend parallel to the tongue axis 120. The coupling element 106 is formed with the slot bottom and top walls (160, 166) as well as with slot sidewalls 170 (only one of which is shown in the sectioned view of FIG. 6) that extend parallel to a horizontal axis (which can be considered coincident with tongue axis 120 shown) and which are positioned so as to be slidably engagable by the corresponding walls (150, 154, 168) of the tongue 118. This engagement limits motion between the tongue 118 and the coupling slot 122 to translational motion along the tongue axis 120, allowing the tongue 118 to firmly support the coupling element 106 when the tongue 118 is raised as shown in FIG. 4. Thus, when the latch pin 152 lockably engages the coupling slot 122 to block such axial motion, this engagement serves to rigidly connect the jack unit 104 with respect to the load 102 throughout the moving procedure.

Figure 7:
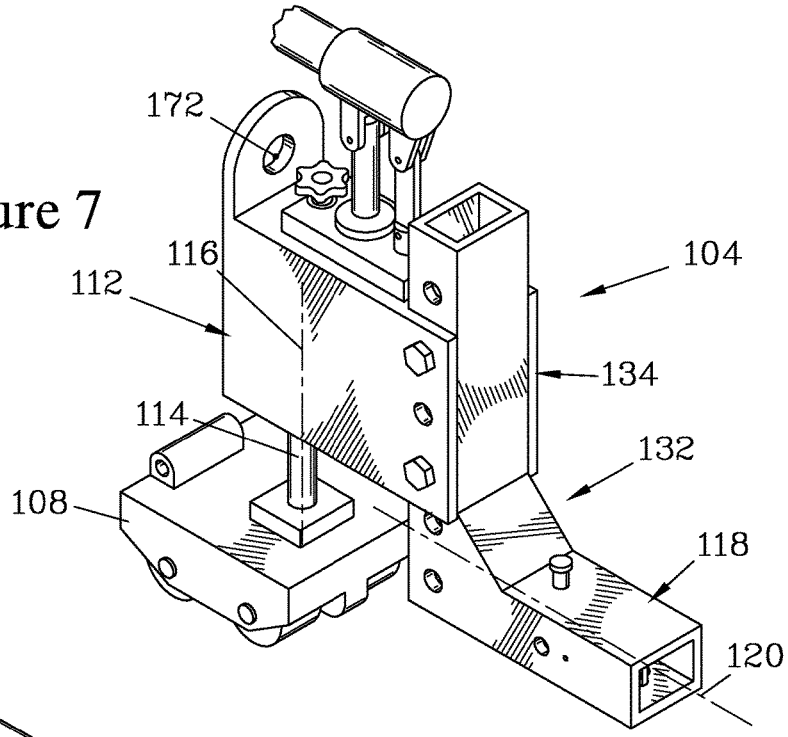
FIG. 7 is an isometric view illustrating the jack unit and skate shown in FIGS. 1-6, but where the extension has been affixed to the jack housing in a lower position in order to couple to an object with a coupling slot placed closer to the level of the underlying surface. The position of the extension is again fixed by cross-bolts that extend through aligned passages in the extension and the jack housing.
Figure 8:
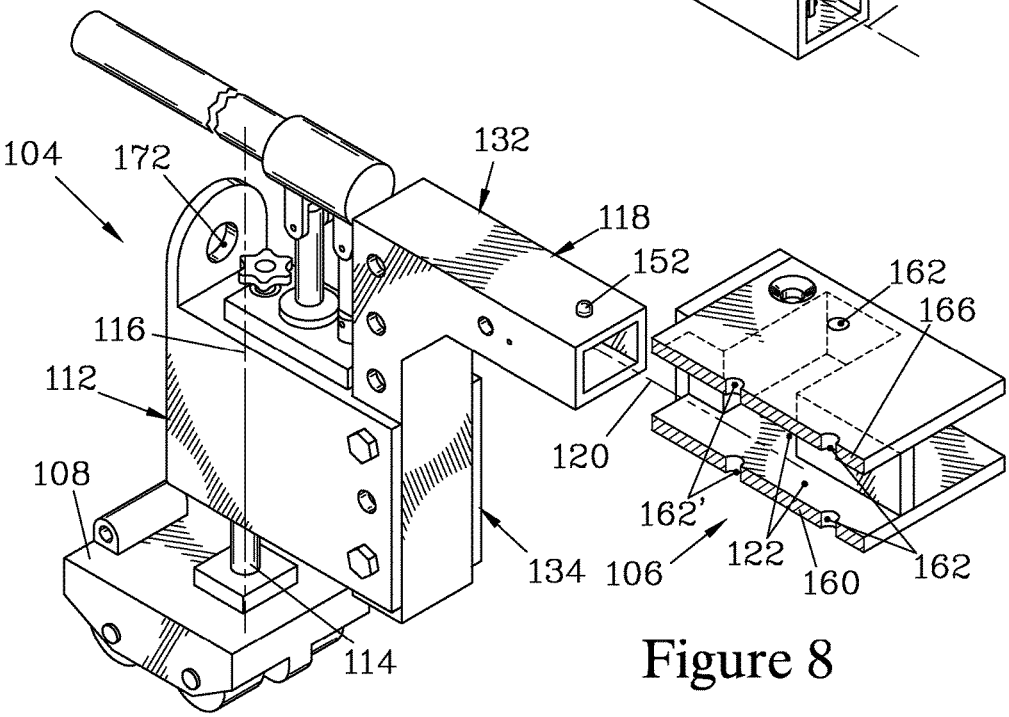
FIG. 8 illustrates the jack unit and skate shown in FIGS. 1-7 when the jack extension has been attached to the jack housing in an inverted position to position the tongue at a greater height, while maintaining a similar extension of the extendable element. The coupling element has a passage to engage the locking pin of the tongue when in such an inverted position.

FIGS. 7 and 8 illustrate how the jack extension 132 can be mounted to the jack housing 112 to place the tongue 118 at various elevations to allow it to lockably engage a coupling slot such as the coupling slot 122 of the coupling element 106 (shown in FIG. 8) when the coupling slot 122 is located at various heights. As shown in FIG. 7, the jack extension 132 has been attached to the jack housing 112 at a position lower than that shown in FIGS. 1-4 for the jack unit 104, allowing the tongue 118 to be placed nearly at the level of the underlying surface. The ability to adjust the height of the tongue 118 relative to the jack housing 112 also allows the jack unit 104 to be employed with various configurations of skates 108, thereby allowing an operator to readily incorporate existing skates into the system 100 to reduce costs.

As shown in FIG. 8, the extension 132 is attached to the jack housing 112 in an inverted position, placing the tongue 118 at a relatively high elevation. Since the latch pin 152 of the tongue 118 is also inverted in this position, the coupling slot 122 for receiving the tongue 118 at such elevation must be constructed to accept the latch pin 152 in this orientation, having latch holes (162, 162') provided in both the slot bottom wall 160 and the slot top wall 166.

The ability to attach the extension 132 to the jack housing 112 at various elevations allows the placement of the tongue 118 at various elevations while maintaining a very limited extension of the extendable element 114, thereby limiting the possible height to which a supported load can be lifted. This height limitation significantly reduces the risk to the operator employing the system of the present invention to lift and transport loads in situations where there is no need to raise the load for placement on an elevated platform. Limiting the extension of the extendable element 114 also serves to reduce bending moments on the extendable element 114. Also, the ability to adjust and reconfigure the jack unit 104 provides it with excellent height range while keeping the parts small and therefore relatively light in weight.

To facilitate lifting the system 100 by a crane or similar hoisting device, each jack unit 104 is provided with a lift eye 172 mounted on the jack housing 112. The use of a crane to lift the system of the present invention is further discussed below.

Figure 9:
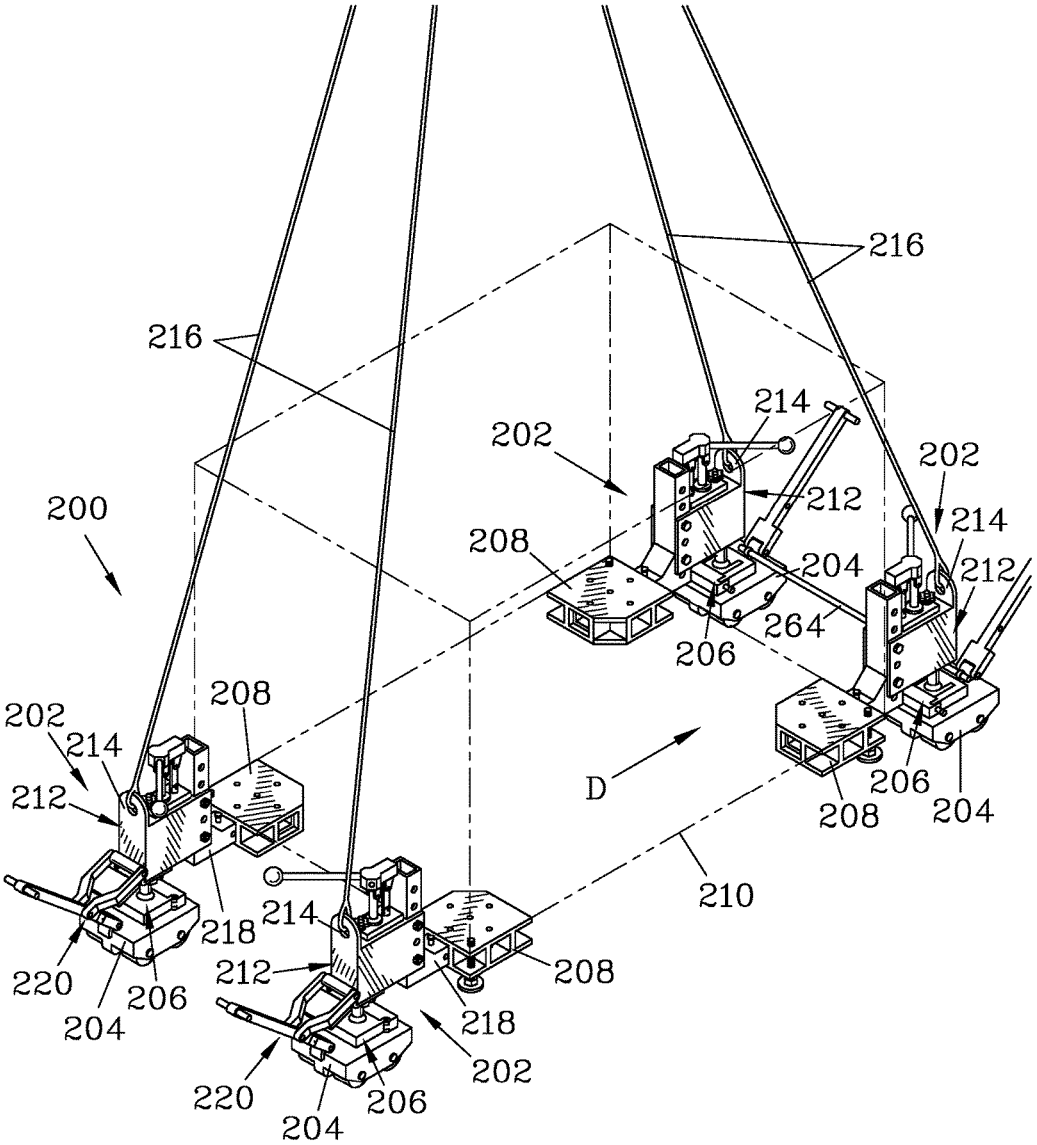
FIG. 9 is an isometric view illustrating a lifting and transporting system which has many features in common with the system illustrated in FIG. 1, and which forms another embodiment of the present invention. In this system, the skates that are trailing when the object is moved (in a direction away from the viewer) are blocked from rotating about the lift axes of the jack units to which they are attached in order to improve the tracking of the system when moved. In this embodiment, motion-limiting knees are connected between the trailing jack units and skates to assure that the trailing skates do not rotate about the lift axis with respect to the jack units. The leading skates are free to rotate, but are connected together by a tie bar connected between the skates. The jacks are illustrated as being attached to forward- and rear-facing slots in the coupling elements, thus reducing the width of the transporting system, and the coupling elements are shown attached directly to the object to be transported, rather than to a free-standing frame.

FIG. 9 is an isometric view illustrating a lifting and transporting system 200 which forms another embodiment of the present invention. The system 200 employs a series of jack units 202 which are attached to skates 204 by ball joints 206, accommodating greater freedom of motion of the skates 204, and which engage coupling elements 208 that are affixed directly to a load 210 (shown in phantom). In this embodiment, the coupling elements 208 are affixed directly to the structure of the load 210 rather than being components of an independent frame, and could be formed as integral parts of the load 210. As shown in FIG. 9, the jack units 202 are engaged with the coupling elements 208 such that the jack units 202 are positioned fore and aft of the load 210, rather than to the side thereof as shown for the system 100 illustrated in FIG. 1. Placing the jack units 202 fore and aft of the load 210 allows the system 200 to more readily traverse a narrow opening, and the system 200 can be configured such that the system 200 does not extend any wider than the load 210 itself. Since all the skates 204 are independently steerable, they can be configured, for example, to roll tangentially and so allow turning the load 210 in its own length.

The jack units 202 each have a jack housing 212 that is provided with a lift eye 214. The lift eyes 214 allow the jack units 202 to be attached to lift straps 216 to enable a crane or other hoist to lift the system 200 and the load 210 attached thereto. When the lift eye 214 is positioned opposite a tongue 218 of the jack unit 202, the jack housing 212 serves as a spreader to help prevent interference of the lift straps 216 with the load 210. Further extension could be provided by designing the coupling elements 208 to latchably engage the tongues 218 in one or more positions where the tongue 218 is not fully inserted; however, as noted above, such extension reduces the load that can be supported by the jack units 202 in such a position. Depending on the shape of the load 210, interference of the straps 216 with the load 210 might also be avoided by positioning the jack units 202 alongside the load 210, rather than on the ends as illustrated in FIG. 9. The ability to rest the load 210 on the coupling elements 208 and reposition the jack units 202 allows the operator to position the jack units 202 alongside for lifting and lowering the load 210, and then reposition the jack units 202 fore and aft of the load 210 (as illustrated) to negotiate a narrow space. It should be noted that the jack units 202 and the skates 204 remain attached to the load 210 as it is lifted and set down at a new location, eliminating any need to position skates or rollers under the load while it is suspended; this eliminates hazard to the operators that would otherwise result from having to work in close proximity to the load 210 while it is suspended.

Figure 10:
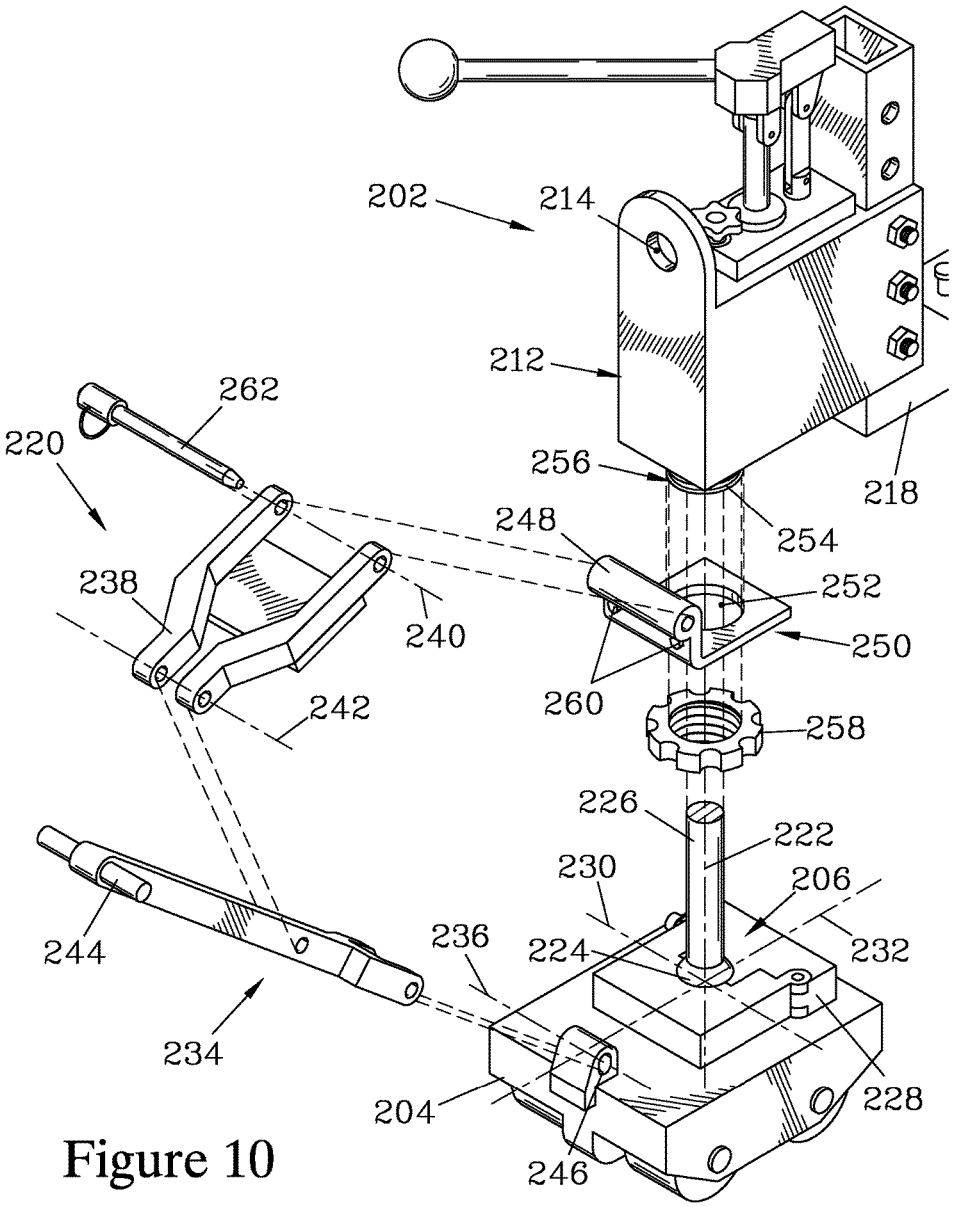
FIGS. 10 and 11 illustrate one of the motion-limiting knees employed in the system shown in FIG. 9.
Figure 11:
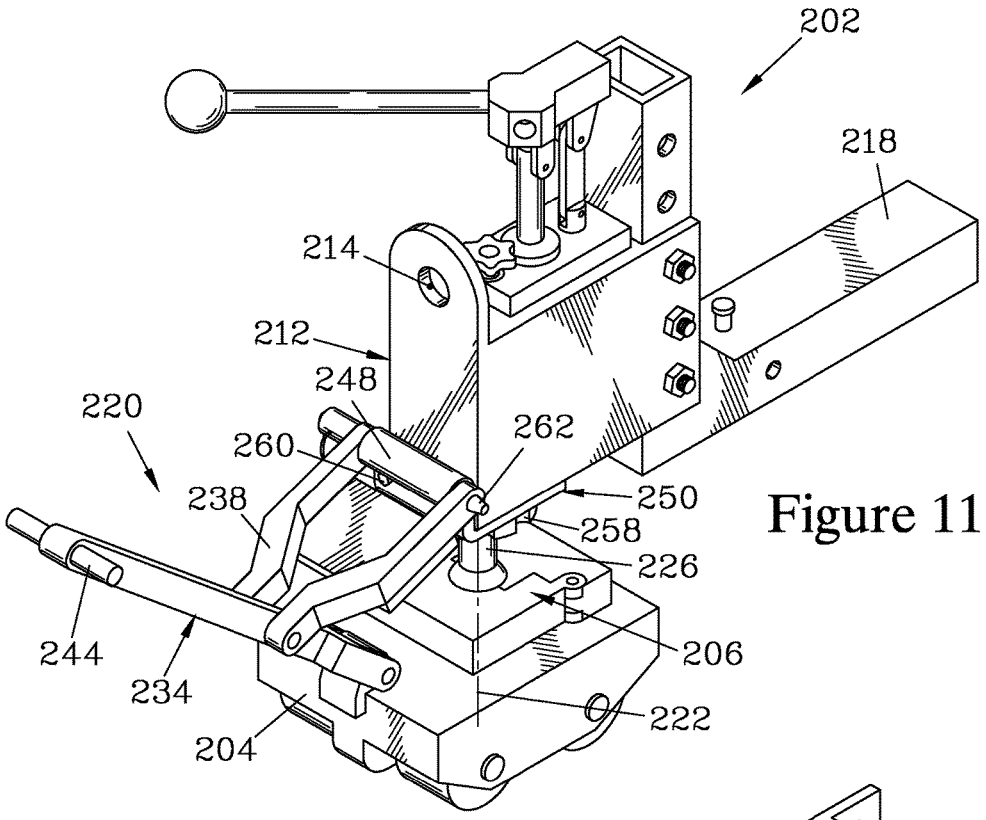

To aid in moving the system 200, the two of the jacks 202 that are trailing as the load 210 is moved in the direction D (away from the viewer) are each provided with a motion-limiting knee 220 that connects between the jack unit 202 and the associated skate 204 to block rotation of the skate 204 about a lift axis 222 (shown in FIGS. 10 and 11). The knee 220 aids the system 200 in tracking straight along a desired path of travel. FIG. 10 shows the elements of the knee 220 exploded, while FIG. 11 shows them when assembled.

While blocking rotation about the lift axis 222 aids in steering, it is still desirable to provide a degree of flexibility to accommodate unevenness in the surface to be traversed. A small degree of unevenness can be accommodated by employing skates that incorporate some flexibility in their structure, such as by employing resilient or pneumatic wheels, and/or by using resilient bushings for the axles on which the wheels are mounted; however, use of resilient materials in the skates typically limits the load capacity of the skate and increases the wear on its components. Such limitations can be overcome by mounting the skates 204 to the jack units 202 via the ball joints 206. Each of the ball joints 206 has a ball 224, which is affixed to an extendable element 226 of the jack unit 202, and a ball receiver 228, which is affixed to the skate 204 and rotatably engages the ball 224. If the skate 204 encounters a surface contour that causes it to tilt relative to the jack housing 212 and tongue 218, such tilting is accommodated by flexibility of the ball joint 206 rather than generating torques on the extendable element 226. The ball receiver 228 must be designed to securely engage the ball 224 in order to connect the skate 204 securely to the extendable element 226 to prevent the skate 204 from becoming detached and presenting a hazard when the jack unit 202 is suspended from a crane via the lift eye 214.

The knee 220 allows a degree of pitching motion (pivoting about a transverse axis 230 that is parallel to the axis of rotation of the wheels of the skate 204) of the skate 204 relative to the jack housing 212 to aid the skate 204 in traversing small obstructions in the path of travel. The connection of the knee 220 to the skate 204 can be designed to also provide limited rolling motion (pivoting about a longitudinal axis 232 that is parallel to the direction of travel of the system 200) of the skate 204 to better accommodate movement over uneven surfaces. For typical applications, it is felt that the flexibility for the skate 204 to pitch about the transverse axis 230 by about ±20° and to roll about the longitudinal axis 232 by about ±5° should be sufficient to accommodate travel over uneven surfaces.

As shown in FIGS. 10 and 11, the knee 220 has a knee lower member 234, which is pivotably attached to the skate 204 about a nominally horizontal lower member pivot axis 236, and a knee upper member 238, which is pivotably attached to the jack housing 212 about a nominally horizontal upper member pivot axis 240; the knee members (234 and 238) in turn are pivotably attached together about a nominally horizontal knee intermediate pivot axis 242. The knee lower member 234 can be extended and provided with a handle 244 to aid the operator in moving the skate 204. The knee lower member 234 attaches to the skate 204 via a vertically-elongated lower pivot passage 246 to provide limited rolling motion about the longitudinal axis 232.

Figure 12:
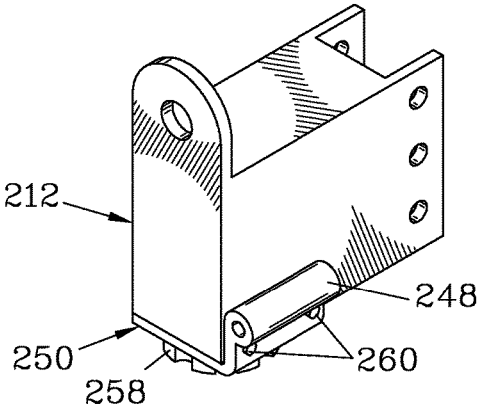
FIG. 12 is an isometric view that illustrates the jack housing and lug shown in FIGS. 10 and 11, where the orientation of the lug plate has been changed to position the knee indexing lug alongside the jack housing, rather than on the end as shown in FIG. 11. This allows positioning the knee and the skate for attaching the jack unit to a coupling element so as to reside alongside the object to be moved (as shown in FIG. 1) rather than in line with the object (as shown in FIG. 9).

In the knee 220, the pivotable attachment of the knee upper member 238 to the jack housing 212 is accomplished by attaching the knee upper member 238 to a knee indexing lug 248 provided on a lug plate 250 that in turn is affixed to the jack housing 212. The lug plate 250 can be attached to the jack housing 212 in one of three orientations, allowing the attachment lug 248 and the knee 220 to be positioned on any of the three sides of the jack housing 212 that do not face towards the tongue 218. FIGS. 10 and 11 shown the knee 220 positioned on an end of the jack housing 212 opposite that from which the tongue 218 extends, for use when the jack units 202 are positioned fore and aft of the load 210, as shown in FIG. 9. When the jack units 202 are positioned beside the load 210 (as is shown in FIG. 1 for system 100 and load 102), the attachment lug 248 can be positioned on one side of the jack housing 212, as shown in FIG. 12. The lug plate 250 has a plate passage 252 (shown in FIG. 10) therethrough that is configured to pass over a threaded end 254 provided on a cylinder 256 from which the extendable element 226 extends. A plate nut 258 threadably attached onto the threaded end 254 to secure the lug plate 250 to the cylinder 256, which in turn is affixed to the jack housing 212.

The lug plate 250 is configured relative to the jack housing 212 such that, when attached thereto, the attachment lug 248 is slightly spaced away from the jack housing 212. A pair of lug alignment bolts 260 can be threadably advanced in the lug plate 250, and are positioned to engage the jack housing 212 when so advanced. The lug alignment bolts 260 can be advanced so as to precisely align the knees 220 that are attached to adjacent skates 204 with respect to each other to correct a toe-in or toe-out situation, and to assure that the adjacent skates 204 are aligned even in the event that the coupling elements 208 to which the jack units 202 are attached are not themselves accurately aligned.

When the knee lower member 234 and the knee upper member 238 are pivotably connected together and to the skate 204 and the attachment lug 248 on the jack housing 212, as shown in FIG. 11, the connection blocks rotation of the skate 204 about the lift axis 222, while allowing the extendable element 226 to freely extend and retract in the cylinder 256.

When it is desired to allow the skate 204 to pivot about the lift axis 222, such as when the system 200 must be rotated or turned, such free motion of the skate 204 can readily be accomplished by removing an upper connector pin 262 that pivotably connects the knee upper member 238 to the attachment lug 248, and pivoting the knee upper member 238 with respect to the knee lower member 234 to a position where it does not interfere with the lug plate 250 or the jack housing 212 as the skate 204 and the knee 220 are pivoted about the lift axis 222. The knee upper member 238 can be designed to fold to a nested position against the knee lower member 234. Alternatively, the knee upper member 238 could be completely removed, as is shown for the leading jack units 202 and skates 204 illustrated in FIG. 9. When such is done, the knee lower member 234, which also serves as a handle for pulling and pushing the skate 204, typically remains attached to the skate 204. If the system 200 is to be moved by a single operator, the leading skates 204 can be connected together by a tie bar 264 to coordinate the rotation of the leading skates 204 about the lift axes 222 of the jack units 202 to which they are attached.

When the knee upper member 238 is disconnected from the attachment lug 248, the plate nut 258 can be unthreaded from the cylinder 256 to allow the lug plate 250 to be dropped down and rotated to position the attachment lug 248 along a different side of the jack housing 212 (as shown in FIG. 12), at which time the lug plate 250 can be raised and resecured to the cylinder 256 in the new position by reattaching and tightening the plate nut 258. This allows the knee 220 to be positioned to aid in tracking when the jack unit 202 is positioned in line with the load 210 or alongside the load 210, as well as allowing the operator to change the direction of travel without requiring space to turn the system 200 and load 210.

When the knee 220 is assembled and connected to both the skate 204 and the jack housing 212, as shown in FIG. 11, the handle 238 formed on the lower knee member 234 is generally fixed in position relative to the jack unit 202 (so long as the extension of the extendable element 214 relative to the jack housing 212 remains constant), and thus the jack unit 202, skate 204, and knee 220 form a rigid unit for greater ease in placing the jack unit 202 into engagement with one of the coupling elements 208.

Figure 13:
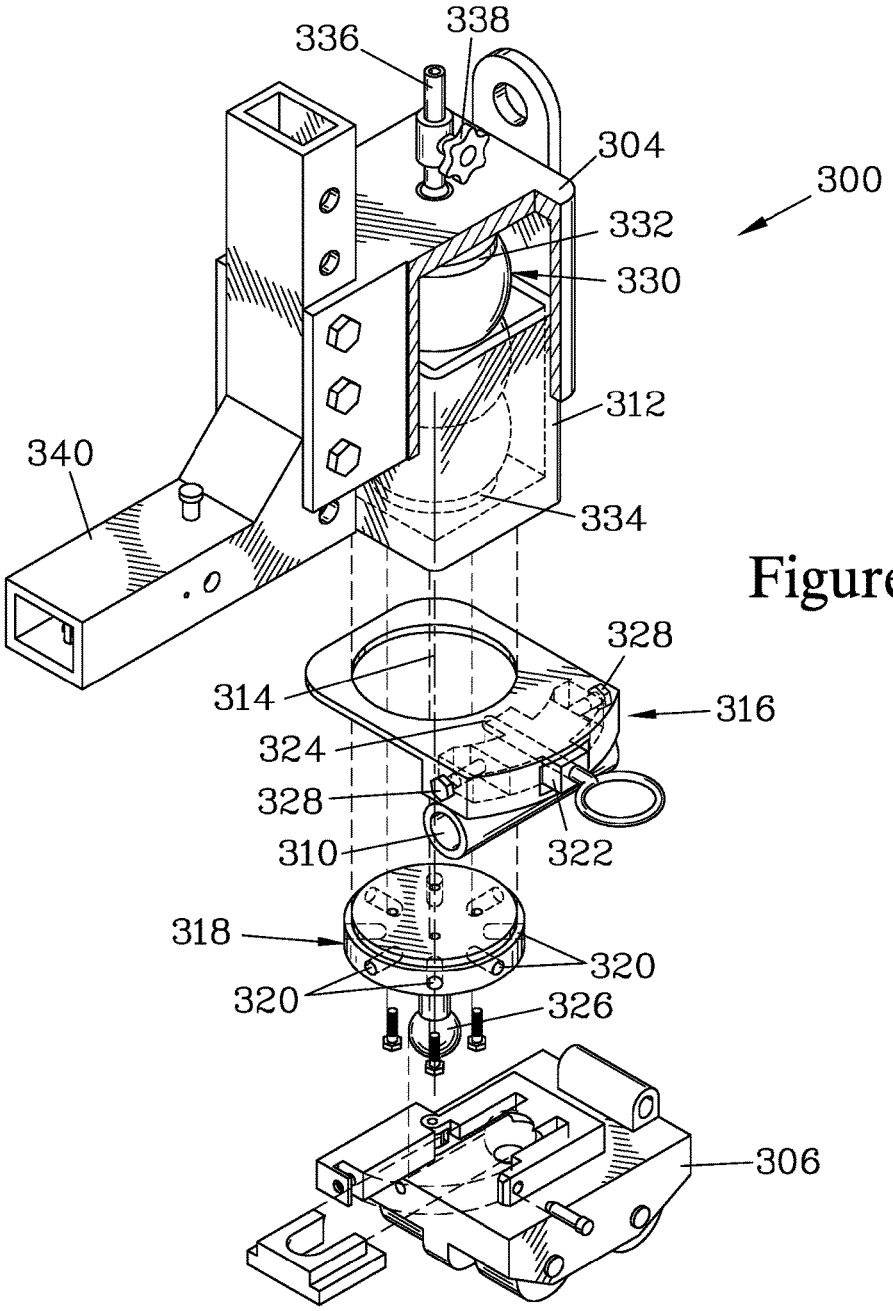
FIGS. 13 and 14 are exploded and assembled views of an alternative structure for connecting a knee between a jack unit and a skate to limit rotation of the skate about a lift axis. In this embodiment, a knee upper member connects to a tube that is affixed to an indexing bracket that in turn rotatably engages an indexing plate affixed to an extendable element of the jack unit. An index pin slidably mounted in the indexing bracket engages one of several index recesses in the indexing plate to block rotation when the indexing bracket, and thus the tube, is in a desired angular position about the lift axis. Jack screws adjust the alignment of the tube relative to the index pin. This embodiment also differs in employing a pneumatic expansion element to extend and retract the extendable element relative to the jack housing, providing a resilient response to impact forces on the skate to reduce their transmission to the load being supported by the jack unit.
Figure 14:
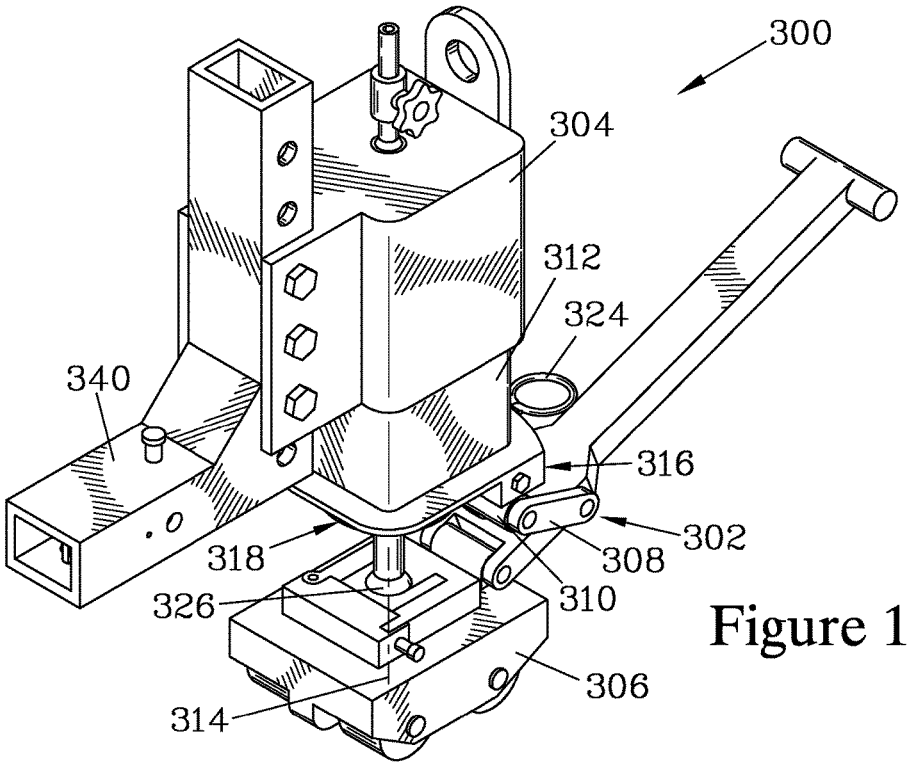

FIGS. 13 and 14 illustrate a jack unit 300 that employs an alternative structure for mounting a knee assembly 302 (shown in FIG. 14) that serves to limit motion between a jack housing 304 and a skate 306. In this embodiment, a knee upper member 308 is pivotably connected to a tube 310 that in turn is adjustably mounted to an extendable element 312 of the jack unit 300, rather than to the jack housing 304. The extendable element 312 of this embodiment is formed as a square tube that telescopes inside the jack housing 304, thus limiting motion between the jack housing 304 and the extendable element 312 to translational motion along a lift axis 314.

The tube 310 is affixed to an indexing bracket 316 that in turn is rotatably mounted to an indexing plate 318; the indexing plate 318 is affixed to the extendable element 312. The indexing bracket 316 rotates with respect to the indexing plate 318 about the lift axis 314. The indexing plate 318 is provided with an array of eight radially-extending index recesses 320, positioned at 45° intervals about the lift axis 314. The indexing bracket 316 has an index block 322 that is translatably engaged by an index pin 324. When the indexing bracket 316 is rotated to a position where the index pin 324 is aligned with one of the index recesses 320, the index pin 324 can be advanced in the index block 322 into the index recess 320, where the engagement of the index pin 324 with the index recess 320 blocks rotation of the indexing bracket 316 with respect to the indexing plate 318. This, in turn, blocks rotation of the tube 310 about the lift axis 314; when the knee assembly 302 is connected between the tube 310 and the skate 306, rotation of the skate 306 about the lift axis 314 is blocked, while pitching and rolling motion is provided by a ball joint 326 that connects the skate 306 to the extendable element 312.

To adjust the alignment of the tube 310 with respect to the jack housing 304, the index block 322 is movably mounted in the indexing bracket 316, and position of the index block 322 in the indexing bracket 316 is adjusted by jack screws 328 mounted in the indexing bracket 316. When the indexing pin 324 is inserted into one of the index recesses 320, adjustment of the jack screws 328 serves to move the position of the index block 322 in the indexing bracket 316, and thus shifts the position of the tube 310 relative to the indexing plate 318.

The jack unit 300 also differs from those discussed above in that it employs a pneumatic expansion element 330 (shown in FIG. 13) to extend or retract the extendable element 312 relative to the jack housing 304; a conventional pneumatic spring can serve as the expansion element 330. The expansion element 330 has a top end 332 attached to the jack housing 304 and a bottom end 334 attached to the extendable element 312. The attachment of the expansion element 330 between the jack housing 304 and the extendable element 312 must be sufficiently secure as to maintain the components of the jack unit 300 together in situations where the jack unit 300 is lifted by the jack housing 304. Additional securing means to prevent separation of the extendable element 312 from the jack housing 304 could be employed for further safety. Air pressure in the expansion element 330 is adjusted by connection to a pneumatic pump or source of pressurized air via a gas connector 336 and a release valve 338; since such sources of pressurized air are frequently available, the need to incorporate a pumping mechanism into the jack unit 300 is avoided, saving expense and weight. Adjusting the pressure in the expansion element 330 causes it to expand and contract, causing the extendable element 312 to extend from or retract into the jack housing 304, thereby raising and lowering a tongue 340 affixed to the jack housing 304 relative to the skate 306. The pneumatic character of the expansion element 330 provides a resilient connection between the skate 306 and the tongue 340, thereby serving to isolate a load attached to the tongue 340 from shocks resulting from travel of the skate 306 over uneven surfaces.

Figure 15:
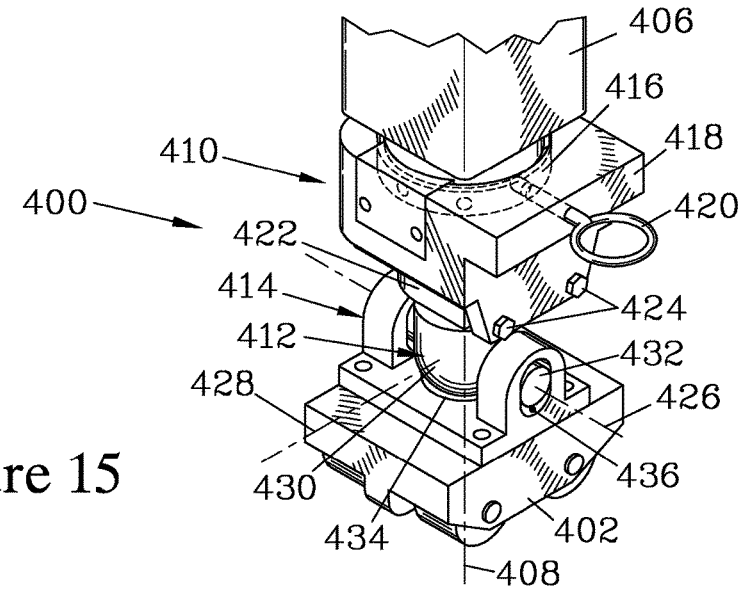
FIGS. 15 and 16 are assembled and exploded views that illustrate an alternative structure for limiting rotation of a skate with respect to a jack unit about a lift axis. Rotation of the skate is limited by a locking swivel in combination with a ball shaft and shaft mount that replace the ball joint employed in earlier embodiments. The locking swivel employs an indexing bracket and indexing plate that function similarly to those shown in FIGS. 13 and 14. The ball shaft is mounted to the indexing bracket and pivotably engages the shaft mount, which is affixed to the skate. The shaft mount engages the ball shaft so as to limit the pivotable motion therebetween, providing a range of pitching motion about a transverse axis, a more limited range of rolling motion about a longitudinal axis, and blocking rotation about the lift axis. The ball shaft is pivotably mounted to the indexing bracket, and jack screws mounted to the indexing bracket engage an adjustment plate on the ball shaft to adjust its alignment.
Figure 16:
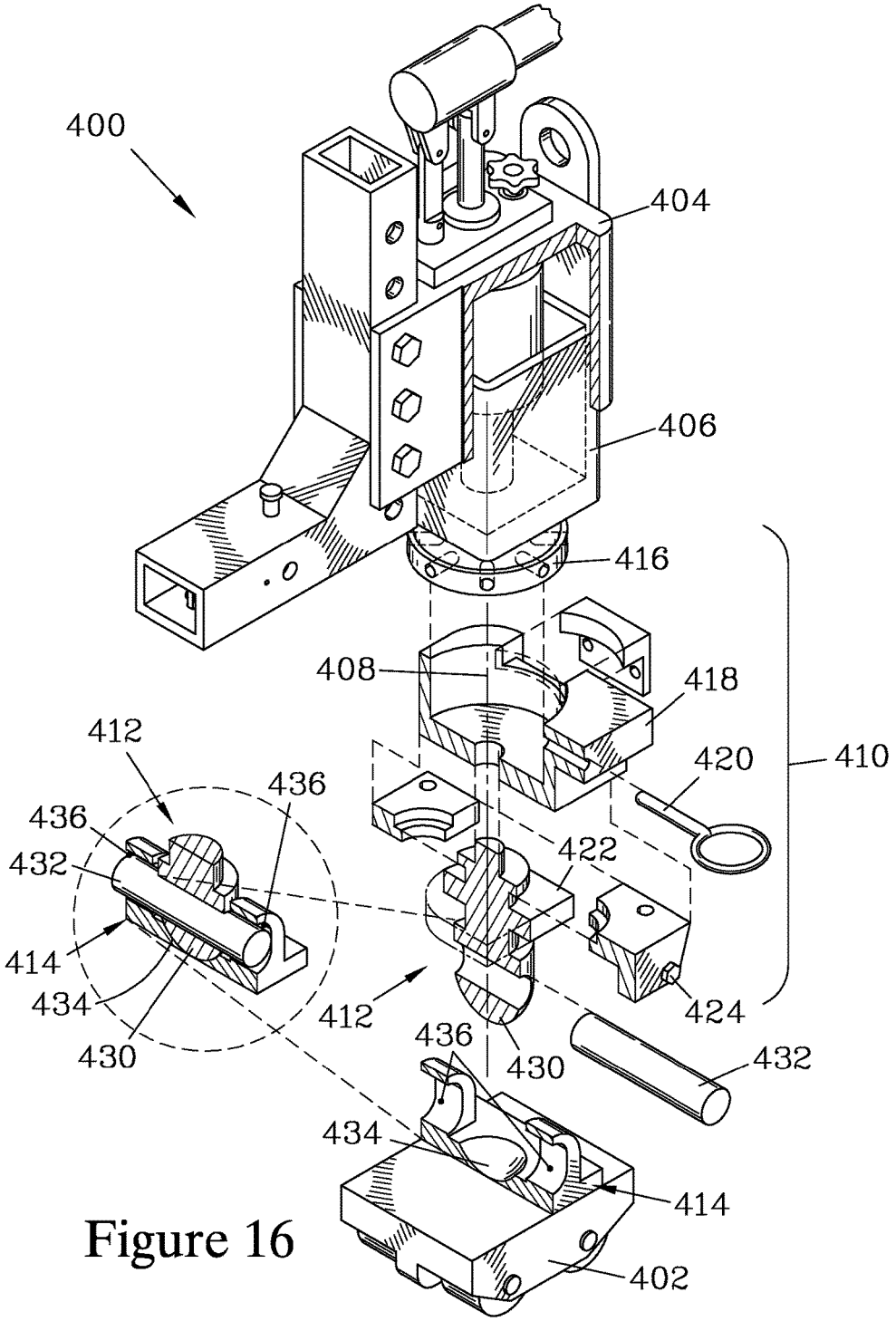

FIGS. 15 and 16 illustrate a jack unit 400 that employs an alternative scheme for limiting motion of a skate 402 with respect to a jack housing 404 (shown in FIG. 16). Again, the jack housing 404 and an extendable element 406 are formed as square telescoping tubes, limiting motion of the extendable element 406 to translation along a lift axis 408. In this embodiment, the skate 402 is attached to the extendable element 406 by a locking swivel 410 (shown assembled in FIG. 15 and exploded in FIG. 16) in combination with a ball shaft 412 that engages a shaft mount 414 to which the skate 402 is affixed.

The locking swivel 410 has an indexing plate 416, which is similar to the indexing plate 318 discussed above, and which is affixed to the extendable element 406. An indexing bracket 418 rotatably engages the indexing plate 416, and is engaged by an index pin 420 that can be advanced into the indexing plate 416 to lock the indexing bracket 418 in a selected one of eight rotational positions about the lift axis 408. In turn, the ball shaft 412 attaches to the indexing bracket 418. While alignment of the indexing bracket 418 relative to the indexing plate 416 could be provided by an index block and jack screws, in this embodiment the alignment is adjusted by pivoting the ball shaft 412 relative to the indexing bracket 418. The ball shaft 412 is pivotably mounted to the indexing bracket 418, and is provided with an adjustment plate 422 that is engaged by a pair of jack screws 424 that limit the pivoting of the ball shaft 412 relative to the indexing bracket 418.

The ball shaft 412 engages the shaft mount 414 in such a manner as to block rotation therebetween about the lift axis 408, while allowing limited pitching motion about a transverse axis 426 and limited rolling motion about a longitudinal axis 428 (these axes being shown in FIG. 15). The ball shaft 412 is provided with a weight-supporting ball-end 430, and a cross-pin 432 that extends horizontally. The shaft mount 414 is provided with a ball-engaging recess 434 that is configured to accept and support the ball-end 430, allowing slidable motion therebetween to provide a similar range of motion to a ball joint such as employed in earlier embodiments. However, this motion is limited by a vertical slots 436 on the shaft mount 414, which engage and constrain the cross pin 432. The vertical slots 436 prevent rotation of the cross pin 432 about the lift axis 408, and allow only a limited range of rolling motion about the longitudinal axis 428, this range being defined by the height of the vertical slots 436. Because the cross-pin 432 is free to rotate with respect to the vertical slots 436 about the transverse axis 426, the range of pitching motion about this axis is limited only by interference of other components, providing a wide range of pitching motion to allow the skate 402 to travel over steps, ledges, and other height differences and obstructions in the surface to be traversed.

Figure 17:
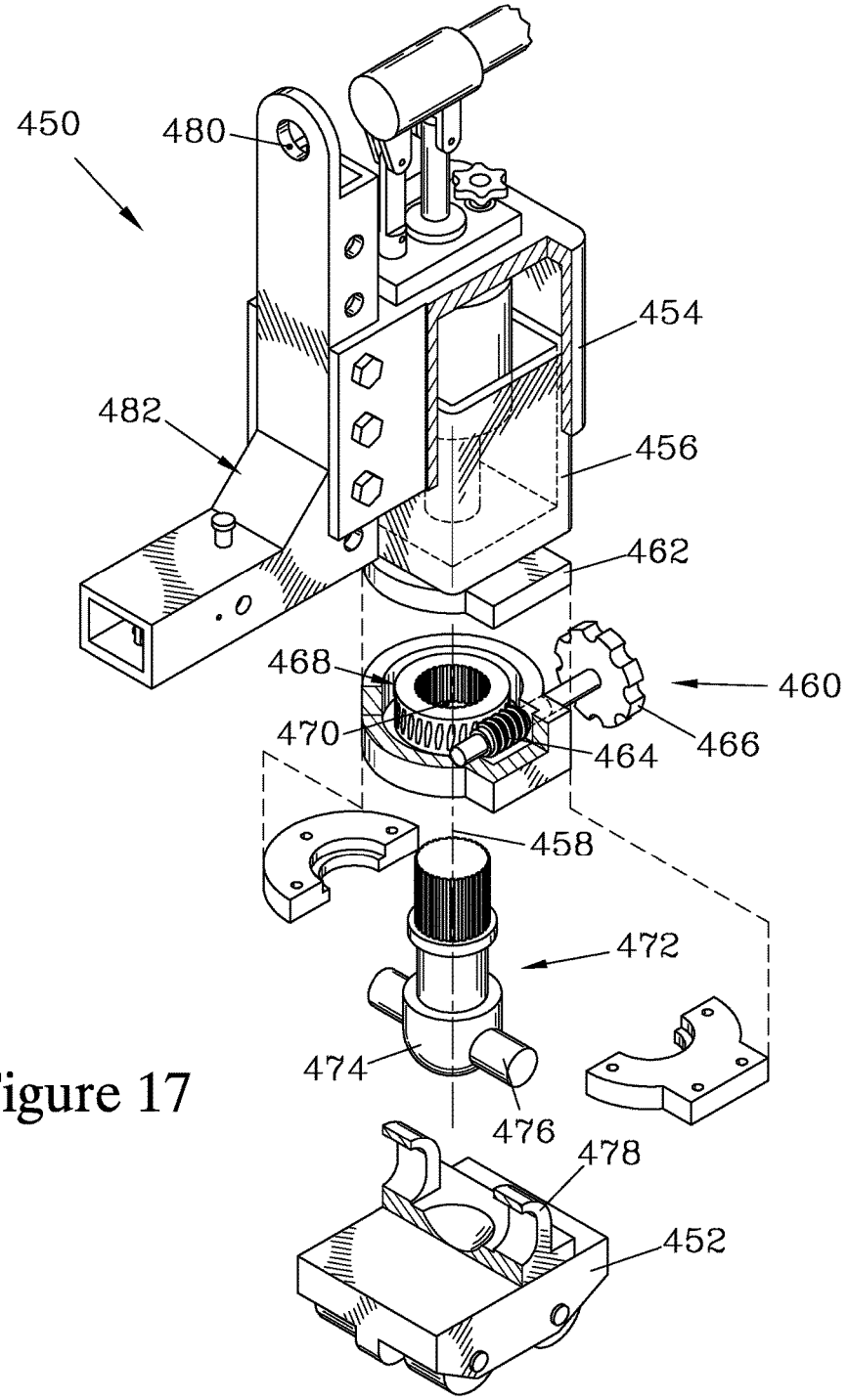
FIG. 17 illustrates a jack unit that employs an alternative scheme for limiting the rotation of the skate when it is in a desired orientation. In this embodiment, a worm drive adjuster is affixed to the extendable element of the jack unit, and houses a worm screw that is manually turned by a hand wheel. The worm screw drives a worm gear that is non-rotatably engaged with a ball shaft, which in turn engages a shaft mount affixed to the skate in a manner similar to the ball shaft and shaft mount shown in FIGS. 15 and 16.

FIG. 17 illustrates a jack unit 450 that employs another alternative scheme for limiting motion of a skate 452 with respect to a jack housing 454, where the jack housing 454 and an extendable element 456 are formed as square telescoping tubes that translate along a lift axis 458. In this embodiment, a worm drive adjuster 460 is provided between the skate 452 and the extendable element 456, and serves to adjust the orientation of the skate 452 about the lift axis 458 in a continuous manner.

The worm drive adjuster 460 is similar to those conventionally employed as slack adjusters, and has an adjuster housing 462 that is affixed to the extendable element 456, a worm screw 464 that is rotatably mounted in the adjuster housing 462 and can be manually rotated by a hand wheel 466, and a worm gear 468 that is mounted in the adjuster housing 462 and driven to rotate about the lift axis 458 by the worm screw 464 when the worm screw 464 is rotated. Typically, the engagement of the worm screw 464 and the worm gear 468 is such as to provide a reduction in the range of 30:1 to 40:1; this ratio is felt to provide a suitable balance between speed in adjusting the orientation of the skate 452 when changing directions and the ability to provide fine adjustment of the steering as well as sufficient resistance to prevent drifting of the alignment.

The worm gear 468 in turn has a splined passage 470 that transmits torque to a ball shaft 472 that has matching splines, and the ball shaft 472 terminates in a ball end 474 with a cross-pin 476. The ball end 474 and the cross-pin 476 engage a shaft mount 478 affixed onto the skate 452, in a similar manner to the ball shaft 412 and shaft mount 414 shown in FIGS. 15 and 16 and discussed above to allow a limited degree of tilting motion while blocking rotation about the lift axis 458. If it is desired to provide a jack unit that provides the skate with the capability to swivel freely when desired, the worm gear adjuster could be mounted to the extendable element via a lockable swivel, which could be similar to the locking swivel 410 discussed above for the embodiment shown in FIGS. 15 and 16.

The jack unit 450 also differs from the jack units discussed above in that it has a lift eye 480 that is provided on a jack extension 482, rather than on the jack housing 454. This positions the lift eye 480 closer to the object to which the jack unit 450 is attached, thereby reducing torques on the jack extension 482.

The motion-limiting structures discussed above may provide a benefit when the jack units of the present invention are adapted for use in other lifting and moving applications. For example, a conventional adapter designed to engage the corner of a standard shipping container could be bolted to the jack housing in place of the jack extension. This modification would allow the modified jack units to lockably engage a shipping container to allow it to be lifted and moved on the skates attached to the jack units. In such an application, the ability to block rotation of the skates in a selected angular position would provide flexibility in moving the container in a desired direction while improving steering.

Figure 18:
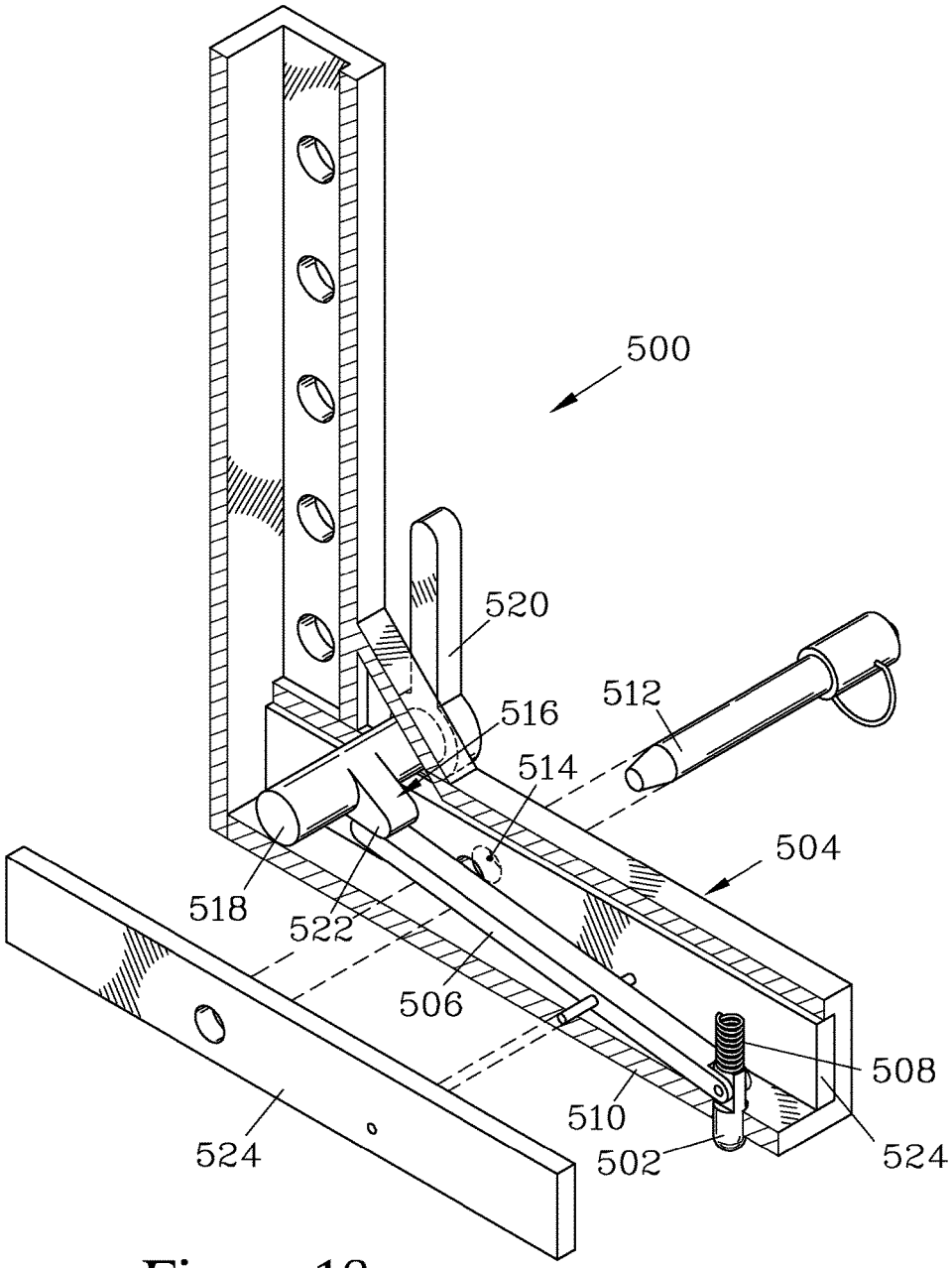
FIG. 18 is a sectioned illustration of a jack extension that can be employed in a jack unit of the present invention to provide greater ease and safety in unlatching a tongue when engaged with a coupling slot. Similarly to the tongue shown in FIGS. 5 and 6, the tongue has a spring-loaded latch pin that is retracted by a pivoting beam. However, in this embodiment the beam is operated by a cam mounted to a cam shaft that is rotated by a latch handle. When the latch handle is rotated by the operator, the cam is rotated and a lug on the cam depresses the beam, retracting the latch pin. The latch handle allows the operator to readily apply sufficient force to retract the latch pin when stuck, and positions the hand of the operator alongside the jack extension to avoid a risk of pinching.

FIG. 18 illustrates a jack extension 500 that employs one alternative means for retracting a latch pin 502 into a tongue 504 to allow the tongue 504 to be disengaged from a coupling slot (not shown). The mechanism for moving the latch pin 502 is similar to that employed in the tongue 118 of the jack extension 132 shown in FIGS. 5 and 6 and discussed above. Again, the latch pin 502 is pivotably attached to one end of a pivoting beam 506, and is biased by a compression spring 508 to an extended position where the latch pin 502 protrudes from a tongue bottom wall 510. Depressing the other end of the beam 506 acts to raise the latch pin 502 against the bias of the compression spring 508 to a retracted position (not shown) where it does not protrude beyond the tongue bottom wall 510, allowing the tongue 504 to slide with respect to the coupling slot. A cross-pin 512 can be inserted through pin passages 514 (only one of which is visible in FIG. 17) through the tongue 504 to block pivoting of the beam 506 when it is desired to secure the latch pin 502 in its extended position.

In the jack extension 500, the beam 506 is depressed by a cam 516 affixed to a cam shaft 518 that is rotatably mounted in the jack extension 500. The cam shaft 518 can be rotated by a latch handle 520 that is located on the exterior of the jack extension 500. When the latch handle 520 is rotated by the operator, a lug 522 on the cam 516 depresses the beam 506, raising the latch pin 502. The latch handle 520 provides the operator with a significant mechanical advantage compared to the release pin 148 employed in the jack extension 132, aiding the operator in overcoming frictional forces on the latch pin 502 due to loading forces between the tongue 504 and the coupling slot. Additionally, when operating the latch handle 520, the hand of the operator is positioned alongside the jack extension 500 at a location spaced away from the coupling slot to avoid a risk of being pinched.

The jack extension 500 also employs a pair of reinforcing plates 524 that add strength to the tongue 504, which preliminary analysis indicates to be the limiting component of the system. The reinforcing plates 524 are inserted into the square tube that forms the tongue 504, doubling effective thickness along the sides to increase the resistance to bending. Additionally, mounting the beam 506 between the reinforcing plates 524 prior to inserting them into the tongue 504 simplifies assembly by assuring the correct positioning of the beam 506 in the tongue 504.

Figure 19:
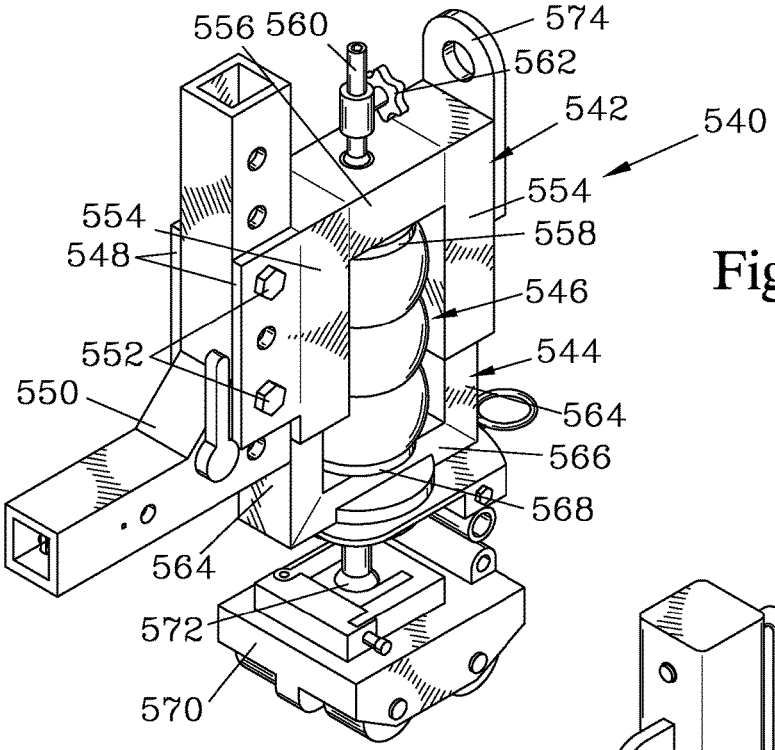
FIG. 19 is an isometric view of another pneumatic jack unit, which employs a jack housing shaped as an inverted U-shape and an extendable element that is U-shaped. The jack housing and the extendable element form a frame that surrounds a pneumatic expansion element, and can readily be fabricated from square tubular stock similar to that used to fabricate the jack extension.

FIG. 19 illustrates a jack unit 540 that is pneumatically operated, similarly to the jack unit 300 shown in FIGS. 13 and 14. The jack unit 540 has a jack housing 542 and an extendable element 544 that form a frame around an expandable expansion element 546. This configuration allows most components of the jack housing 542 and the extendable element 544 to be fabricated from readily available square tube stock. The jack housing 542 has a pair of mounting plates 548 to which a jack extension 550, fabricated from similar tube stock, can be affixed by bolts 552.

The jack housing 542 is formed by a pair of vertically-extending housing columns 554 connected together by a housing top brace 556, to which an upper end 558 of the expansion element 546 is attached. An air supply connector 560 is mounted to the housing top brace 556 and communicates with the expansion element 546 via an air valve 562 to allow connecting the expansion element 546 to a source of pressurized air. The pressure in the expansion element 546 can be adjusted to increase or decrease its height under a particular load to change the height of the extendable element 544 relative to the jack housing 542. Again, an air spring such as are employed in vehicle suspensions could be employed as the expansion element 546, and the use of a pneumatic expansion element 546 provides the jack unit 540 with a resilient response when traversing uneven surfaces.

The extendable element 544 has a pair of spaced apart extendable element columns 564 connected together by an extendable element bottom brace 566, and each of the extendable element columns 564 inserts into one of the housing columns 554 and is vertically movable therein to vary the separation between the housing top brace 556 and the extendable element bottom brace 566 as the expansion element 546 expands and contracts, while retaining the braces (556, 566) substantially parallel. The extendable element bottom brace 566 is attached to a lower end 568 of the expansion element 546, and is also attached to a skate 570 by a ball joint 572. The expansion element 546 should be securely attached to the housing top brace 556 and the extendable element bottom brace 566 to retain the extendable element 544 in the event that the jack unit 540 is lifted, such as by a crane attached to a lift eye 574 provided on the jack housing 542. For increased safety, an additional connection could be provided to maintain the extendable element 544 and the jack housing 542 engaged together at all times to prevent the extendable element 544 and the skate 570 from dropping, such as a slot cut in one of the extendable element columns that is engaged by the end of a bolt mounted in the corresponding housing column. The configuration of the jack housing 542 serves to place the lift eye 574 at a distance from the jack extension 550, serving to spread the locations at which lift straps are attached to the jack unit 540 to more easily clear a load to which the jack unit 540 is attached. However, such an extended position of the lift eye 547 increases the moment arm of torques on the jack extension 550.

Figure 20:
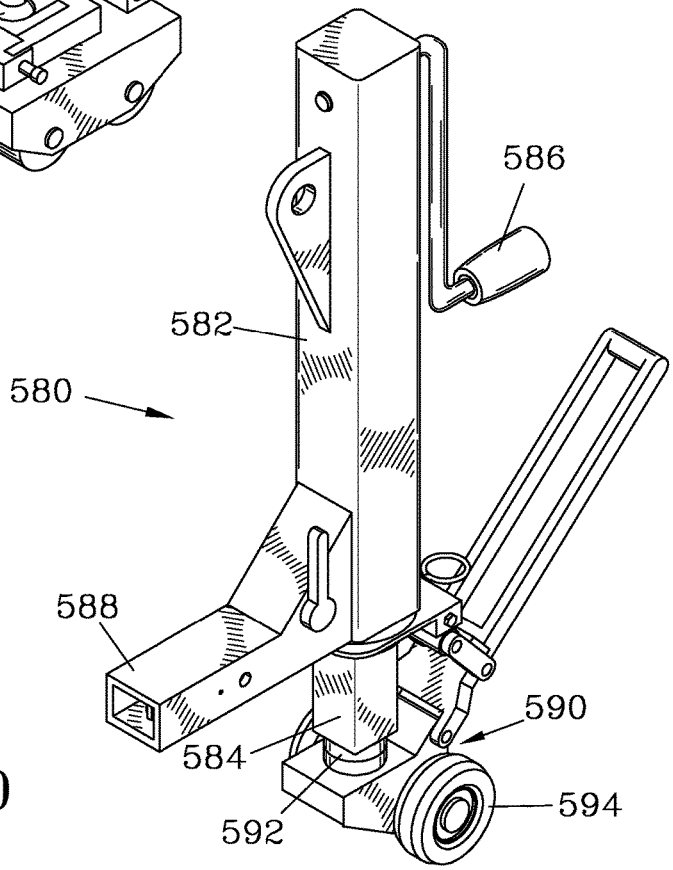
FIG. 20 is an isometric view illustrating one example of a jack unit designed for a particular application. In this embodiment, the jack unit is intended for lifting and transporting relatively small loads over surfaces that are susceptible to damage, and for travel over surfaces having a large variation in height; possible applications include the installation and replacement of rooftop HVAC units and the installation of stone countertops, fireplaces, and other features in buildings having finished floor surfaces. The jack unit has a tongue that is fixed to the jack housing, and employs a mechanical jack to extend and retract an extendable element. While the use of a mechanical jack limits the load capacity and makes the system impractical for a single operator, it does provide a long extension of the extendable element from the jack housing, providing greater lift height than the other embodiments discussed. The skate is provided with pneumatic wheels to accommodate uneven surfaces and to reduce the risk of damage to the surface on which the jack unit transports a load.

FIG. 20 illustrates a jack unit 580 that differs from the jack units discussed above in that it is designed for use lifting and moving relatively lightweight loads that must be raised a substantial distance. Examples of such situations include moving rooftop HVAC units, which typically must be placed on a raised platform having a height of about one foot above the surrounding roof surface, and installation of interior fixtures that must be moved up or down a staircase, and thus raised a sufficient height to clear one or more steps. The jack unit 580 has a jack housing 582 and an extendable element 584 formed by a conventional mechanical jack such as typically used with trailers. In such jacks, an internal gear mechanism (not shown) operates to extend and retract the extendable element 584 in response to operation of a manual crank 586. A tongue 588 is affixed directly to the jack housing 582, and a skate 590 is mounted to the extendable element 584 via a swivel joint 592. To avoid damage to an underlying surface and accommodate unevenness in the surface to be traversed, the skate 590 is provided with pneumatic wheels 594.

Figure 21:
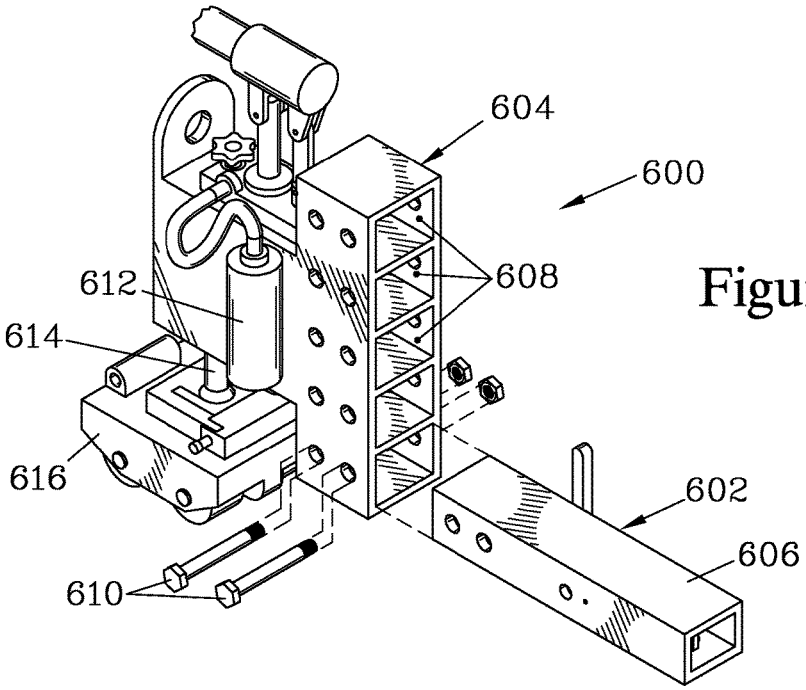
FIG. 21 is an isometric view of a jack unit that forms another embodiment of the present invention, and which uses an alternative scheme for attaching a jack extension to the jack housing so as to vary the height of the tongue. In this embodiment, the jack housing is formed with a series of vertically-arranged tongue receptors, and the jack extension is slidably accepted into the desired receptor to determine the height. This jack unit also employs a hydraulic accumulator to dampen the effect of traversing a bumpy surface and to maintain pressure in the event that the skate attached to the jack unit encounters a depression in the surface being traversed. The accumulator provides a shock-absorbing character similar to that of a jack unit that employs a pneumatic expansion element (such as shown in FIG. 13), while allowing a greater load capacity by employing a hydraulic mechanism rather than a pneumatic mechanism to extend and retract the extendable element.

FIG. 21 is an isometric view of another jack unit 600 that can be employed in a lifting and transporting system of the present invention. The jack 600 employs alternative structure for adjustably affixing a jack extension 602 to a jack housing 604 so as to allow adjusting the height of a tongue 606 on the jack extension 602. The jack housing 604 is formed with a vertically-positioned series of receptors 608, each of which is configured to slidably accept the jack extension 602. The jack extension 602 can be secured in the desired one of the receptors 608 by extension bolts 610.

The jack unit 600 also employs a hydraulic accumulator 612 that is connected in fluid communication with a cylinder (not shown) to provide a reserve pressure to maintain the extension of an extendable element 614, which is attached to a skate 616. The hydraulic accumulator 612 serves to maintain a relatively even lifting force in the event that the skate 616 encounters a depression in the surface being traversed. The hydraulic accumulator 612 acts to pressurize the cylinder and thereby dampen the effect of the release of pressure that would otherwise occur, thereby allowing the system to traverse an uneven surface while maintaining a load supported on the system level within a specified tolerance. While illustrated outside of the jack housing 604, the hydraulic accumulator 612 could be housed within the jack housing 604 to make the jack unit 600 more compact.

Figure 22:
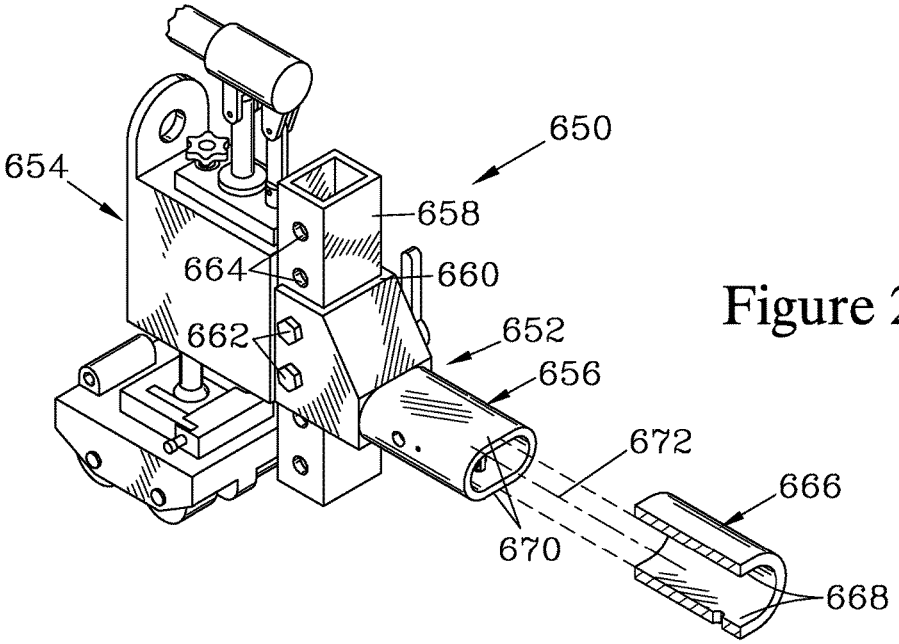
FIG. 22 is an isometric view of a jack unit of another embodiment of the present invention, which employs another alternative means for attaching a jack extension to the jack housing. In this embodiment, the jack housing is provided with a vertical column to which an extension channel on the jack extension can be attached at a desired location by use of bolts passing through aligned passages. The jack extension also has a tongue with a non-rectangular cross section, designed to attach to a corresponding coupling slot on an object to be moved.

FIG. 22 illustrates another jack unit 650, that employs another alternative means for attaching a jack extension 652 to a jack housing 654 to vary the elevation of a tongue 656 formed on the jack extension 652. In this embodiment, the jack housing 654 is provided with a vertical column 658 which is slidably engaged by an extension channel 660 on the jack extension 652. Once the jack extension 652 is located along the column 658 with the tongue 656 at the desired height, the column 658 and the extension channel 660 can be secured together by bolts 662 that pass through aligned passages 664 in the column 658 and the extension channel 660.

The jack unit 650 also employs a different cross section for the tongue 656, which is intended to match a coupling slot 666 that has an oval section, with two flat slot segments 668. The tongue 656 has a corresponding cross section, with two flat tongue segments 670 that extend parallel to a tongue axis 672. When the tongue 656 is inserted into the coupling slot 666, the engagement of the flat segments (668, 670) blocks rotation of the tongue 656 about the tongue axis 672 with respect to the coupling slot 666, thereby maintaining the jack unit 650 upright despite torques caused by loads on the tongue 656 or by movement of the jack unit 650 along a surface to be traversed.

Figure 23:
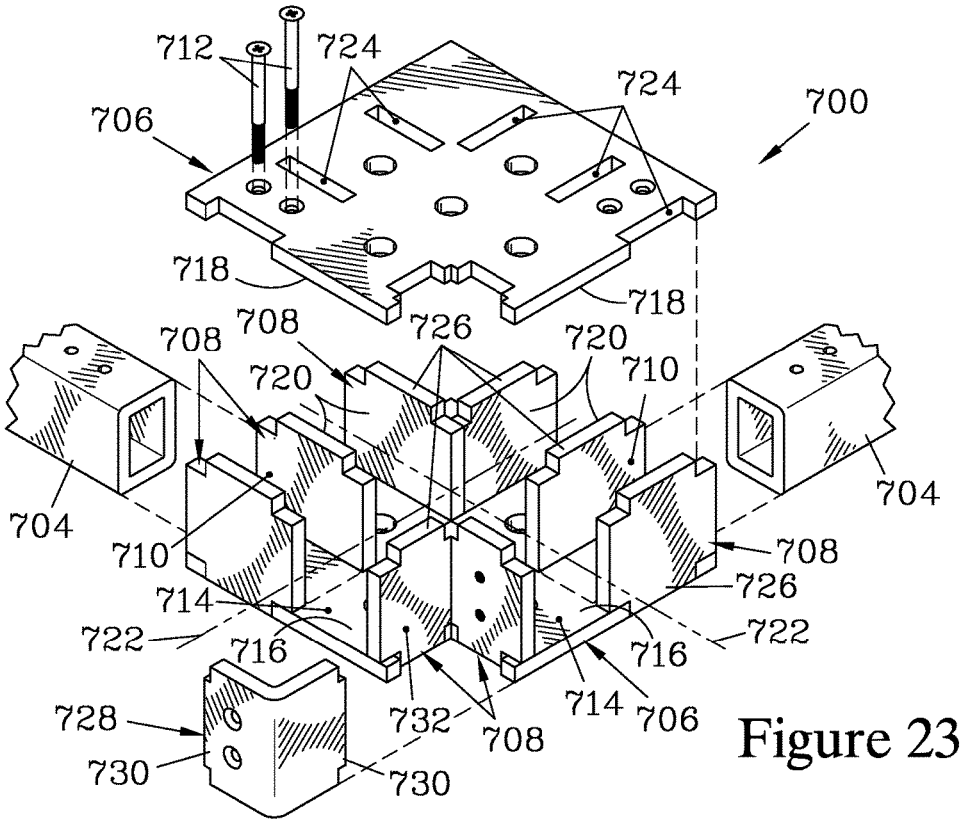
FIG. 23 is a partially exploded view of a coupling element that can be employed in place of the coupling elements shown in FIGS. 1 and 9, as well as a pair of frame members that can be attached to the coupling element so as to form the frame to which an object to be moved can be secured. The frame members can be readily formed from tube stock, allowing a frame of the desired size for a particular object to be transported to be readily formed and assembled, and to be assembled about the object when desired. The coupling element is formed from pieces that attach via tab-and-slot connections, which can be readily welded to secure the pieces together. When assembled, the pieces form two coupling slots, each of which is configured to latchably and supportably engage a tongue of a jack unit. Additionally, the coupling element has a pair of horizontal frame member receptors configured to slidably accept ends of the frame members, which can then be secured to the coupling element by frame bolts to form one corner of the frame. A vertical frame member receptor is also provided, allowing a vertical frame member to be attached to the coupling element.
Figure 24:
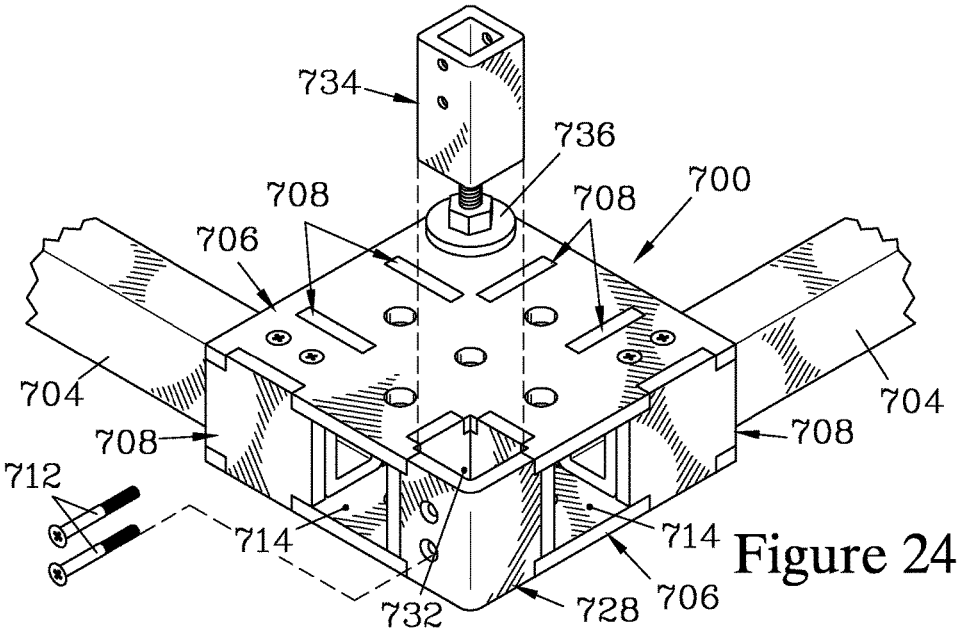
FIG. 24 shows the coupling element and frame members shown in FIG. 23 when the two frame members have been bolted to the horizontal frame member receptors of the coupling element, and a vertical frame member, having an adjustable foot mounted thereto, is ready to be inserted into the vertical frame member receptor.
Figure 25:
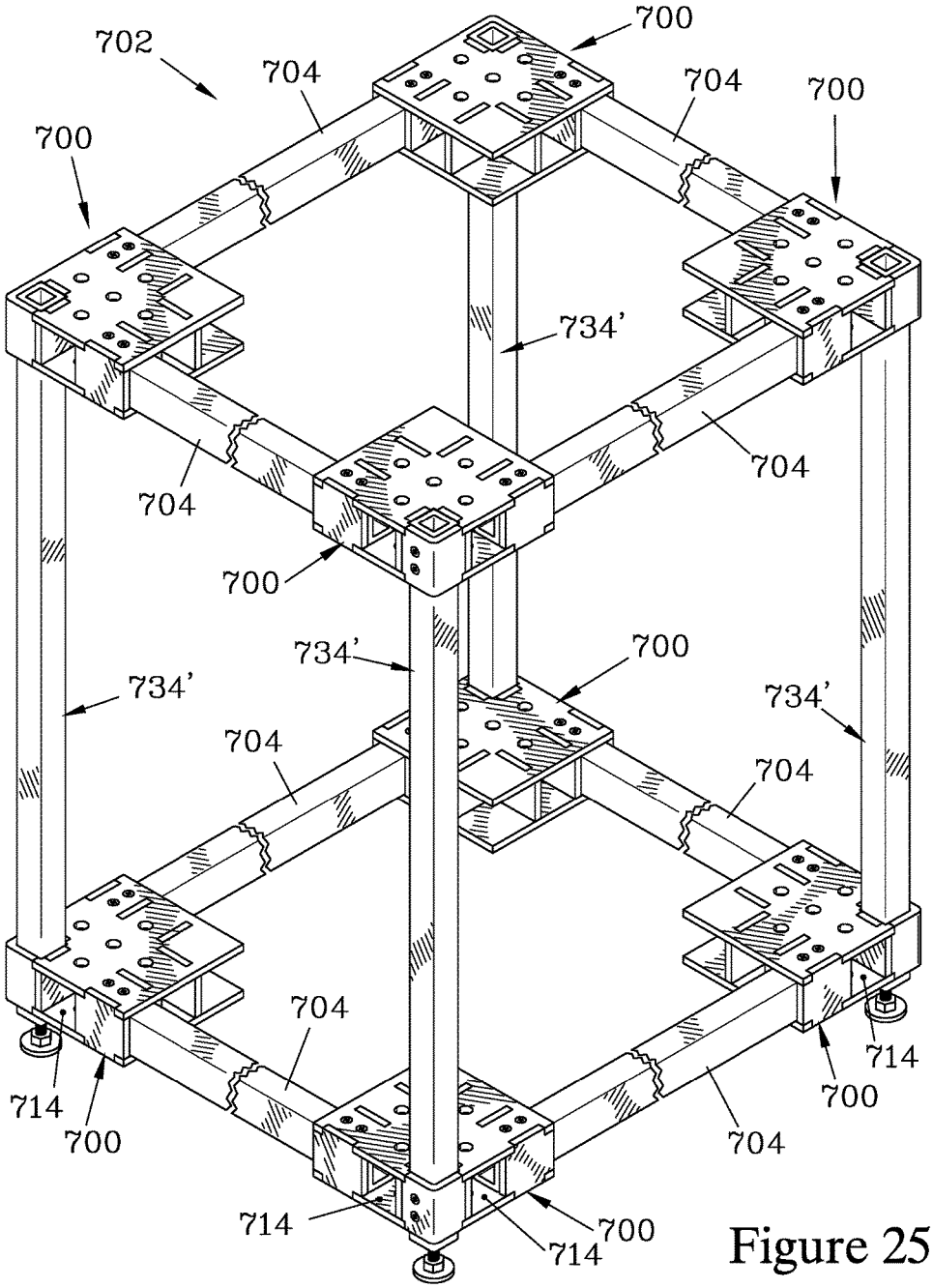
FIG. 25 is an isometric view of a frame formed by coupling elements and frame members such as those shown in FIGS. 23 and 24. Since the frame members can be readily formed by cutting tube stock to length and drilling holes for securing bolts, the coupling elements allow a frame to be readily fabricated in a desired size, as well as allowing the frame to be constructed around an object to be moved.

FIGS. 23 through 25 illustrate details of a coupling element 700 that can be secured to an object to allow attachment of a jack unit such as discussed above. The coupling element 700 could be attached directly to an object to me moved, or can be used to form a corner of a free-standing frame 702 (shown in FIG. 25) to which an object to be moved can be secured by bolts, strapping, or similar means known in the art. FIG. 23 illustrates the coupling element 700 partially exploded, while FIG. 24 illustrates the coupling element 700 assembled and engaged with two horizontal frame members 704.

The coupling element 700 has a pair of horizontal plates 706 that, when the coupling element 700, is assembled, are held apart by a series of vertical web members 708. The web members 708 are positioned and sized such that the assembled coupling element 700 is provided with outer channels 710 that are sized to slidably accept the frame members 704. Once inserted, bolts 712 can be used to affix the frame members 704 in place, as shown in FIG. 24. The web members 708 are further distributed so as to define two orthogonal, intersecting coupling slots 714 for lockably accepting a tongue of a jack unit in the manner shown in FIG. 6 for the tongue 118 and coupling slot 122. Each coupling slot 714 is bounded by a slot bottom wall 716, formed by one of the horizontal plates 706, a slot top wall 718, formed by the other plate 706, and opposed slot sidewalls 720 formed by the web members 708. Providing a pair of coupling slots 714 that extend orthogonally to each other allows a jack unit to be positioned either on the side or on the end of the frame 702. The walls (716, 718, and 720) of each of the coupling slots 714 extend parallel to a horizontal axis 722, and are configured to allow the tongue of a jack unit to be inserted along the horizontal axis 722, while limiting off-axis motion.

To facilitate fabrication, the horizontal plates 706 are provided with plate slots 724 (labeled in FIG. 23) and the web members 708 are provided with corresponding tabs 726 that are configured to engage the plate slots 724 to accurately position the web members 708 and to allow the components (706, 708) of the coupling element 700 to be assembled and then welded together without requiring any internal welds.

The coupling element 700 also includes a corner piece 728 formed of angle stock, which is provided with corner tabs 730 that are sized to fit between the plates 706 and abut against two of the web members 708. The corner piece 728, in combination with these two web members 708, forms a vertical frame member receptor 732 into which a vertical frame member 734 (shown in FIG. 24) can be secured with additional bolts 712. In FIG. 24, the vertical frame member 734 is formed as a leg, which is provided with a threadably adjustable foot 736. Alternatively, a longer vertical frame member having a series of passages for receiving bolts could be employed to allow the operator to adjust the extension of the vertical frame member below the coupling element 700 to provide a leg of a desired length. When it is desired for the frame 702 formed by the coupling elements 700 to either partially or entirely surround the object to be moved, a vertical frame member 734' can be employed that extends upwards from the coupling element 700, as shown in FIG. 25.

Using the coupling elements 700, the frame 702 can be readily formed in the desired size by cutting the frame members (704, 734') from conventional tubular stock to the desired lengths and then drilling them to accept the bolts 712. Furthermore, the frame 702 can be formed about the object to be moved while the object remains in position.

Figure 26:
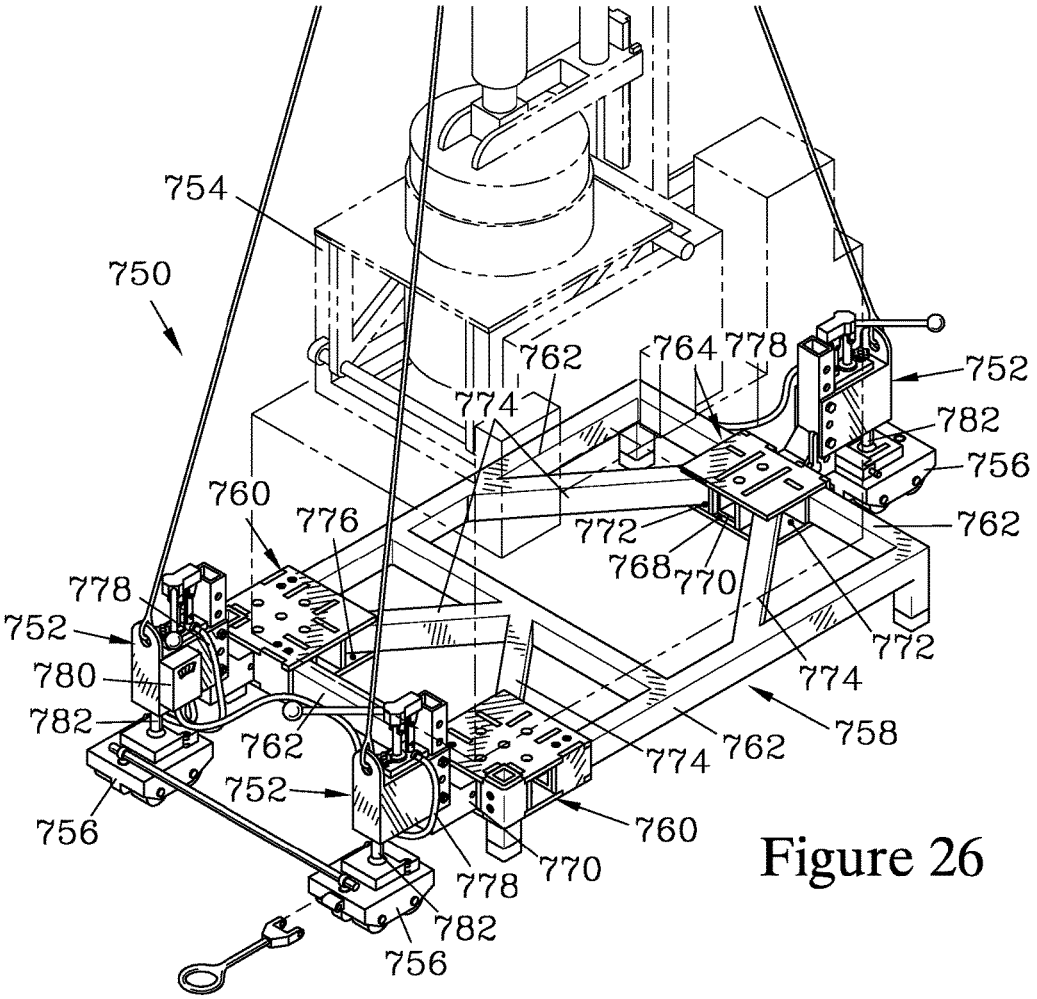
FIG. 26 is an isometric view illustrating another embodiment of the present invention, a lifting and transporting system that employs only three jack units to support the object to be moved. This system has a benefit in that all three of the skates bear a portion of the load at all times, provided the center of gravity resides internal to the triangle formed by the three skates, preventing a situation where the load is supported on only two skates. This system is also illustrated as having a welded frame and a pressure equalization system that communicates the hydraulic fluid pressure between all of the jack units. The system can be pressurized by pumping any pump handle or a combination of pump handles. Hoses connect the pumping cylinders to equalize or regulate the pressure. If the center of gravity is centrally located, then when the frame is leveled, each of the jacks should bear equal loads. In this embodiment, a dedicated side coupling element is employed, which is designed to accept frame rails at 180° positions, and which only has one slot for accepting the tongue of one of the jack units. The side coupling element has rear pockets into which diagonal members of the frame can be inserted before welding them in place.

FIG. 26 is an isometric view illustrating another embodiment of the present invention, a lifting and transporting system 750 that employs only three jack units 752 to support an object 754 (shown in phantom) to be lifted and transported. The use of only three jack units 752 assures that the weight of the load 754 is distributed at all times among the three jack units 752, providing the center of gravity of the object 754 falls within the triangle formed by the three jack units 752 and is reasonably centered; this avoids the possibility of a situation in which, due to unevenness of a surface being traversed, the object 754 becomes supported on only two jack units 752, which could result in overloading of the jack units 752. The jack units 752 are flexibly attached to skates 756, and are lockably engaged to a frame 758 to which the load 754 is affixed.

Figure 27:
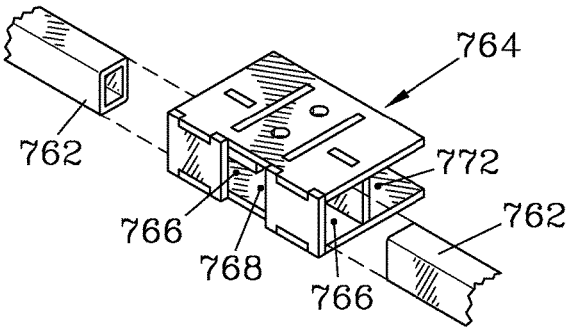
FIG. 27 is an enlarged view of the side coupling element employed in the frame shown in FIG. 26, which could also be employed along the side of an especially long object in order to attach additional jacks and skates to more evenly distribute the load.

The frame 758 of this embodiment is a welded frame with two corners formed by corner coupling elements 760 (which are similar to the coupling elements 700 shown in FIGS. 23-25), while the remaining two corners are formed by directly joining together frame members 762. The frame members 762 are also welded to a side coupling element 764 that provides an attachment point for the third jack 752. The side coupling element 764 is better shown in FIG. 27, and has a pair of opposed channels 766, each of which can slidably accept one of the frame members 762. The channels 766 bracket a single coupling slot 768, which is configured to lockably accept a tongue 770 (shown in FIG. 26) of one of the jack units 752. The side coupling element 764 also has a pair of inner corner pockets 772, into which supplemental frame members 774 can be welded to provide diagonal supports, as shown in FIG. 26. Similarly, supplemental frame members 774 are inserted into an inner corner pocket 776 formed in each of the corner coupling elements 760, providing greater rigidity for the frame 758, as well as serving to brace the coupling elements 760 against torques imparted by the jack units 752 when supporting especially heavy loads. The side coupling element 764 could also be employed in situations where it is desired to form an elongated frame with locations along the sides of the frame to attach additional jack units in order to better distribute the weight of an elongated load.

The system 750 also differs from the systems discussed earlier in that the jack units 752 are connected together by hydraulic lines 778 and a hydraulic controller 780 that equalize the pressure between the three jack units 752, to coordinate the extension of their extendable elements 782. This coordination allows the jack units 752 to lift the object 754 in a coordinated manner to maintain the object 754 level and avoid tipping, and allow the system 750 to be operated by an individual. When the hydraulic controller 780 includes a pressure gauge, the weight of the object 754 can be calculated based on the indicated pressure. It should be appreciated that the weight of the load supported by any system of the present invention that employs hydraulic jack units could alternatively be calculated by use of pressure gauges associated with each of the individual jack units.

FIG. 28 illustrates a lifting and transporting system 800 having a frame 802 that has been adapted to provide improved maneuverability in confined spaces. The system 800 is designed for use with relatively light, compact loads, and employs four jack units 804 that employ pneumatic jacks similar to the jack unit 500 shown in FIG. 19. The frame 802 is formed from coupling elements 806 that serve as corners that connect together frame members 808 in a manner similar to that of the coupling elements 700 and frame members 704 of the frame 702 shown in FIG. 25. The frame 802 differs in that it is provided with supplementary wheel attachments 810 that are attached to two of the frame members 808 prior to assembly of the frame 802. One of these supplementary wheel attachments 810 is better shown in FIG. 29.

The supplementary wheel attachment 810 has a tubular sleeve 812 sized to slide over the frame member 808, and has a pair of axle supports 814 affixed thereto so as to reside below the tubular sleeve 812. A supplementary wheel 816 is mounted to an axle 818 that in turn is mounted between the axle supports 814 in such a manner that the supplementary wheel 816 can rotate about a supplementary wheel axis 820 that is orthogonal to a longitudinal axis 822 of the tubular sleeve 812. A set bolt 824 is mounted through the tubular sleeve 812 and can be threadably advanced to lock against the frame member 808 to fix the supplementary wheel attachment 810 in a desired position.

The supplementary wheels 816 attached to the frame 802 can be activated or deactivated by raising and lowering the jack units 804 relative to skates 826 attached thereto. In the system 800, the skates 826 are provided with caster wheels 828. When the jack units 804 are lowered to an extent that the supplementary wheels 816 extend below a plane on which the caster wheels 828 reside, the frame 802 is supported in the middle on the supplementary wheels 816 and at one end by the caster wheels 828 of the pair of skates 826 at that end. Since the caster wheels 828 are free to move in any direction, the operator can readily maneuver the system 800 by turning it at the location of the supplementary wheels 816. When it is desired to deactivate the supplementary wheels 816, to support the frame 802 at its ends rather than at the center and one end, the operator can activate the jack units 804 to raise the frame 802, and the supplementary wheel attachments 810 that are mounted thereon, to an elevation sufficient that the supplementary wheels 816 are raised off the underlying surface.

The modular construction of the frames made using the coupling elements of the present invention allows additional elements to be readily added in a similar manner to the supplementary wheel attachments 810 discussed above. Two examples of such attachments are shown in FIGS. 30 and 31 and discussed below.

FIG. 30 illustrates a forklift pocket attachment 850 that could be attached to a frame to provide structure to allow the frame to be readily transported by a forklift Again, the forklift pocket attachment 850 has a tubular body 852 sized to slide over a frame member, and has a pair of set bolts 854 that can be threadably advanced through the tubular body 852 to lock against the frame member inserted therethrough. The set bolts 854 fix the forklift pocket attachment 850 in place to prevent slippage in use. The forklift pocket attachment 850 has a pair of tine pockets 856 affixed to the tubular body 852 so as to reside below the tubular body 852. The tine pockets 856 are configured to be engaged by the tines of a conventional forklift (not shown) to allow the forklift to pick up the frame to which the forklift pocket attachment 850 is affixed. While the attachment 850 has a pair of tine pockets 856, a pair of attachments each having a single tine pocket could be employed.

FIG. 31 illustrates an anchor point attachment 870 that provides an anchor slot 872 for attaching a strap to secure an object to a frame on which the anchor point attachment 870 is mounted. Again, the anchor point attachment 870 has a tubular body 874 configured to slidably engage a frame member prior to assembly of the frame, and a set bolt 876 that can be advanced to lock the tubular body 874 in place at a desired location.

While the novel features of the present invention have been described in terms of particular embodiments and preferred applications, it should be appreciated by one skilled in the art that substitution of materials and modification of details can be made without departing from the spirit of the invention.

What is claimed is:

1. A jack unit for releasably attaching a load-bearing skate to an object to be moved, the skate having at least two rolling elements and the object being provided with a coupling slot having slot bearing surfaces that extend parallel to a horizontal axis and a slot latching structure, the jack unit comprising:

a jack housing;

an extendable element that is forcibly movable relative to said jack housing along a vertical lift axis;

a tongue affixed with respect to said jack housing so as to extend along a horizontal tongue axis and having, tongue bearing surfaces that extend parallel to the tongue axis and are configured to slidably engage the slot bearing surfaces so as to limit motion therebetween to translation along the tongue axis, and a tongue latching structure that is engageable with the slot latching structure of the coupling slot when said tongue bearing surfaces are engaged with the slot bearing surfaces, such engagement acting to block slidable motion between said tongue bearing surfaces and the slot bearing surfaces;

means for retracting said tongue latching structure from engagement with the slot latching structure, thereby allowing the jack unit to be removed from engagement with the coupling slot while the coupling slot remains secured to the object; and skate attachment means for lockably attaching the skate to said extendable element so as to vary a separation of the skate from said jack housing measured along the lift axis as said extendable element is forcibly moved relative to said jack housing.

2. The jack unit of claim 1 wherein said skate attachment means attaches the skate to said extendable element in such a manner as to allow the skate to rotate about the lift axis relative to said jack housing, the jack unit further comprising:

a motion-limiting structure that can be selectively coupled between the skate and at least one of said jack housing and said extendable element so as to block rotation of the skate about the lift axis when the skate is in one of at least two angular positions with respect to the lift axis.

3. The jack unit of claim 2 wherein said motion-limiting structure further comprises:

an alignment adjustment mechanism that allows and maintains fine adjustment of the angular position of the skate when said motion-limiting structure is coupled so as to block rotation of the skate about the lift axis.

4. The jack unit of claim 3 wherein said motion-limiting structure further comprises:

a skate swivel joint having, a swivel joint lower member connected to said skate attachment means in such a manner as to block rotation of the skate with respect to said swivel joint lower member about the lift axis, and a swivel joint upper member connected to said extendable element and rotatably connected to said swivel joint lower member so as to provide pivotal motion therebetween about the lift axis; and swivel blocking means that can be selectively activated to block rotation between said lower and upper swivel joint members when said lower and upper swivel joint members are in one of at least two rotational positions about the lift axis with respect to each other.

5. The jack unit of claim 4 wherein said skate attachment means are configured to allow the skate a limited degree of pivoting motion relative to said extendable element about a skate pitch axis that is perpendicular to the lift axis and parallel to an axis of rotation of at least one of the rolling elements of the skate and wherein said swivel blocking means further comprise:

an indexing disk that forms a part of said swivel joint upper member;

a lower member indexing structure non-rotatably attached to said swivel joint lower member and pivotably engaging said indexing disk so as to rotate with respect thereto about the lift axis; and a selectively engagable indexing latch interacting between said indexing disk and said lower member indexing structure so as to block rotation therebetween when said indexing disk and said lower member indexing structure are in one of at least two rotational orientations with respect to each other about the lift axis.

6. The jack unit of 1 wherein said tongue is provided on a jack extension that can be affixed to said jack housing at multiple vertical positions.

7. The jack unit of claim 6 for use with a coupling element wherein the slot bearing surfaces are provided by, a downward-facing slot upper bearing surface, an upward facing slot lower bearing surface that is opposed to the slot upper bearing surface, a pair of opposed slot side bearing surfaces, and wherein said tongue bearing surfaces further comprise:

a tongue upper bearing surface configured to slidably engage the slot upper bearing surface of the coupling slot, a tongue lower bearing surface configured to slidably engage the slot lower bearing surface of the coupling slot, a pair of opposed tongue side bearing surfaces configured to slidably engage the slot side bearing surfaces of the coupling slot.

8. The jack unit of claim 6 wherein said jack housing further comprises:

a lift eye spaced apart from said tongue along said tongue axis.

9. A lifting and transporting system comprising:

the jack unit of claim 7; and a coupling element secured to the object to be moved and having, a first coupling slot extending along a first horizontal axis and configured to slidably accept said tongue of said jack unit, said first coupling slot having, a downward-facing first slot upper bearing surface configured to slidably and supportably engage said tongue upper bearing surface, an upward-facing first slot lower bearing surface configured to slidably and supportably engage said tongue lower bearing surface, a pair of oppositely-facing first slot side bearing surfaces configured to slidably and supportably engage said tongue side bearing surfaces, and a first slot latching structure configured to be releasably engaged with said tongue latching structure when said tongue bearing surfaces are engaged with said first slot bearing surfaces, such engagement acting to block slidable motion between said tongue bearing surfaces and said first slot bearing surfaces; and a second coupling slot extending along a second horizontal axis that is orthogonal to the first horizontal axis, said second coupling slot configured to slidably accept said tongue of said jack unit and having, a downward-facing second slot upper bearing surface configured to slidably and supportably engage said tongue upper bearing surface, an upward-facing second slot lower bearing surface configured to slidably and supportably engage said tongue lower bearing surface, a pair of oppositely-facing second slot side bearing surface configured to slidably and supportably engage said tongue side bearing surfaces, and a second slot latching structure configured to be releasably engaged with said tongue latching structure when said tongue bearing surfaces are engaged with said second slot bearing surfaces, such engagement acting to block slidable motion between said tongue bearing surfaces and said second slot bearing surfaces.

10. The lifting and transporting system of claim 9 wherein said first coupling slot and said second coupling slot intersect each other.

11. The lifting and transporting system of claim 10 wherein said tongue latching structure of said jack unit is a retractable latching pin and, said first slot latching structure is provided by a plurality of first slot latch holes, each of which is positioned to receive said retractable latching pin when said tongue is inserted into said first coupling slot to a particular depth; and said second slot latching structure is provided by a plurality of second slot latch holes, each of which is positioned to receive said retractable latching pin when said tongue is inserted into said second coupling slot to a particular depth.

12. The lifting and transporting system of claim 11 wherein said coupling element is configured to accept elongated frame members so as to form a corner of a rigid frame, said coupling element further comprising:

a first frame member receptor extending along a first receptor axis that is parallel to the first horizontal axis, said first frame member receptor being configured to slidably accept an elongated first frame member and to engage the first frame member so as to prevent off-axis motion between said coupling element and the first frame member; and a second frame member receptor extending along a second receptor axis that is parallel to the second horizontal axis, said second frame member receptor being configured to slidably accept an elongated second frame member and to engage the second frame member so as to prevent off-axis motion between said coupling element and the second frame member.

13. The lifting and transporting system of claim 12 wherein said coupling element further comprises:

a third frame member receptor extending along a vertical third receptor axis that is orthogonal to the first receptor axis and to the second receptor axis, said third frame member receptor being configured to slidably accept an elongated third frame member and to engage the third frame member so as to prevent off-axis motion between said coupling element and the third frame member.

14. A selectively steerable jack unit for releasably attaching a load-bearing skate having at least two rolling elements to an object to be moved having an array of standardized lifting brackets, the jack unit comprising:

a jack housing;

an extendable element that is forcibly movable relative to said jack housing along a vertical lift axis;

a lifting element affixed with respect to said jack housing and configured to releasably, lockably engage one of the lifting brackets on the object and configured to engage the object so as to affix said jack housing with respect to the object when said lifting element is lockably engaged therewith, and being releasable from engagement with the lifting bracket to allow removing the jack unit while the lifting bracket remains secured to the object;

skate attachment means for lockably attaching the skate to said extendable element so as to be rotatable with respect thereto about the lift axis and so as to allow a limited degree of pivotal motion about a skate pitch axis that is perpendicular to the lift axis and parallel to an axis of rotation of at least one of the rolling elements of the skate, said skate attachment means securing the skate to said extendable element so as to vary a separation of the skate from said jack housing measured along the lift axis as said extendable element is forcibly moved relative to said jack housing; and a motion-limiting structure that can be selectively coupled between the skate and at least one of said jack housing and said extendable element so as to block rotation of the skate about the lift axis when the skate is in one of at least two angular positions with respect to the lift axis, while allowing the skate a limited degree of pivoting motion relative to said extendable element about the skate pitch axis.

15. The selectively steerable jack unit of claim 14 wherein said motion-limiting structure also allows the skate a limited degree of pivoting motion relative to said extendable element about a longitudinal axis that is perpendicular to the lift axis and to the skate pitch axis.

16. The selectively steerable jack unit of claim 14 wherein said motion-limiting structure further comprises:

a skate swivel joint having, a swivel joint lower member connected to said skate attachment means in such a manner as to block rotation of the skate with respect to said swivel joint lower member about the lift axis, and a swivel joint upper member connected to said extendable element and rotatably connected to said swivel joint lower member so as to provide pivotal motion therebetween about the lift axis; and swivel blocking means that can be selectively activated to block rotation between said lower and upper swivel joint members when said lower and upper swivel joint members are in one of at least two rotational positions about the lift axis with respect to each other.

17. A selectively steerable jack unit for releasably attaching a load-bearing skate having at least two rolling elements to an object to be moved that is provided with an array of standardized coupling slots, each coupling slot having slot bearing surfaces that extend parallel to a horizontal slot axis, the jack unit comprising:

a jack housing;

an extendable element that is forcibly movable relative to said jack housing along a vertical lift axis;

a tongue affixed with respect to said jack housing so as to extend along a horizontal tongue axis and having, tongue bearing surfaces that extend parallel to the tongue axis and are configured to slidably engage the slot bearing surfaces of one of the coupling slots so as to limit motion between said tongue and the coupling slot to translation along the tongue axis;

means for lockably engaging said tongue with the coupling slot so as to affix said jack housing with respect to the object, said means for lockably engaging said tongue with the coupling slot being releasable from engagement to allow removing the jack unit while the coupling slot remains secured to the object;

skate attachment means for lockably attaching the skate to said extendable element so as to be rotatable with respect thereto about the lift axis, said skate attachment means securing the skate to said extendable element so as to vary a separation of the skate from said jack housing measured along the lift axis as said extendable element is forcibly moved relative to said jack housing; and a motion-limiting structure that can be selectively coupled between the skate and at least one of said jack housing and said extendable element so as to block rotation of the skate about the lift axis when the skate is in one of at least two angular positions with respect to the lift axis.

18. The selectively steerable jack of claim 17 wherein said motion-limiting structure further comprises:

an alignment adjustment mechanism that allows and maintains fine adjustment of the angular position of the skate when said motion-limiting structure is coupled so as to block rotation of the skate about the lift axis.

* * * * *